US007289756B2

(12) United States Patent
Hasegawa et al.

(10) Patent No.: US 7,289,756 B2
(45) Date of Patent: Oct. 30, 2007

(54) DEVELOPER REGULATING MEMBER WITH SURFACE ROUGHNESS PARAMETERS

(75) Inventors: Hideaki Hasegawa, Meridian, ID (US); Keiji Okano, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 11/255,974

(22) Filed: Oct. 24, 2005

(65) Prior Publication Data

US 2007/0065185 A1 Mar. 22, 2007

(30) Foreign Application Priority Data

Sep. 20, 2005 (JP) ..... 2005-272981

(51) Int. Cl.
*G03G 15/08* (2006.01)

(52) U.S. Cl. ..... 399/274; 399/284

(58) Field of Classification Search ..... 399/274, 399/284

See application file for complete search history.

(56) References Cited

U.S. PATENT DOCUMENTS

| | | | | |
|---|---|---|---|---|
| 5,084,733 | A | 1/1992 | Katoh et al. | 355/251 |
| 5,177,537 | A | 1/1993 | Okano et al. | 355/259 |
| 5,185,496 | A * | 2/1993 | Nishimura et al. | 399/275 |
| 5,235,386 | A | 8/1993 | Yano et al. | 355/219 |
| 5,286,917 | A | 2/1994 | Unno et al. | 118/651 |
| 5,519,472 | A | 5/1996 | Ojima et al. | 355/246 |
| 5,589,924 | A | 12/1996 | Yano et al. | 399/350 |
| 5,781,835 | A | 7/1998 | Okano et al. | 399/275 |
| 6,058,284 | A | 5/2000 | Okano et al. | 399/284 |
| 6,195,522 | B1 | 2/2001 | Sato | 399/284 |
| 6,226,464 | B1 | 5/2001 | Suwa et al. | 399/27 |
| 6,370,348 | B1 | 4/2002 | Okano et al. | 399/256 |
| 6,829,447 | B2 | 12/2004 | Okano | 399/55 |
| 6,909,869 | B2 | 6/2005 | Yamamoto et al. | 399/284 |
| 7,003,249 | B2 | 2/2006 | Hasegawa et al. | 399/254 |

FOREIGN PATENT DOCUMENTS

| | | |
|---|---|---|
| JP | 62-242975 | 10/1987 |
| JP | 4-55872 | 2/1992 |

(Continued)

*Primary Examiner*—Quana Grainger
(74) *Attorney, Agent, or Firm*—Fitzpatrick, Cella, Harper & Scinto

(57) ABSTRACT

A developer regulating member abutting against a developer carrying member carrying a mono-component developer to regulate the layer thickness of the developer on the developer carrying member has a supported portion supported by a support member, and an abutting portion abutting against the developer carrying member, the surface roughness parameters of this abutting portion satisfying the following expressions (1) to (5):

$$0.30 \leqq Sm \leqq 0.170 \quad (1)$$

$$Rpk \leqq 2.0 \quad (2)$$

$$Rp \leqq 5.0 \quad (3)$$

$$0.10 \leqq Rvk \times (100 - Mr2)/100 \leqq 1.30 \quad (4)$$

$$Rpk < Rvk, \quad (5)$$

where Sm is a mean spacing [mm] of profile irregularities prescribed by JIS-B0601-1994, Rp is a maximum profile peak height [μm] prescribed by ISO4287-1997, Rpk is an initial wear height [μm] prescribed by DIN4776, Rvk is an oil retaining depth [μm] prescribed by DIN4776, and Mr2 is a profile bearing length ratio 2 [%] prescribed by DIN4776.

18 Claims, 9 Drawing Sheets

FOREIGN PATENT DOCUMENTS

| | | |
|---|---|---|
| JP | 5-188748 | 7/1993 |
| JP | 6-52448 | 2/1994 |
| JP | 9-80904 | 3/1997 |
| JP | 2000-227713 | 8/2000 |
| JP | 2000-275964 | 10/2000 |
| JP | 2000-330376 | 11/2000 |
| JP | 2001-117356 | 4/2001 |
| JP | 2001-117357 | 4/2001 |
| JP | 2002-23491 | 1/2002 |
| JP | 2004-12542 | 1/2004 |
| JP | 2004-117919 | 4/2004 |

* cited by examiner $$Sm = \frac{\sum_{1}^{n} Smi}{n}$$

DEVELOPER REGULATING MEMBER WITH SURFACE ROUGHNESS PARAMETERS

BACKGROUND OF THE INVENTION

1. Field of the Invention

The invention relates to an image forming apparatus such as a laser beam printer or a copying machine for forming an image on a recording material by the use of an electrophotographic printing method or an electrostatic recording method. More particularly, this invention relates to a developer layer thickness regulating member for use in a developing apparatus using a mono-component developer, and a developing apparatus, a cartridge and an image forming apparatus provided with the same.

2. Description of the Related Art

An electrophotographic image forming apparatus such as, for example, a copying machine or a laser beam printer applies light corresponding to image data to an electrophotographic photosensitive member (photosensitive member) to thereby form an electrostatic image (latent image). Then, the toner of a developer which is a recording agent is supplied from a developing apparatus to the electrostatic image to thereby visualize the electrostatic image as a toner image. This toner image is transferred from the photosensitive member to a recording material such as recording paper by a transferring device. This toner image is fixed on the recording material by a fixing device, whereby a recorded image is formed.

There have been proposed various developing apparatuses using a dry type mono-component developing method. The following may be taken as an example. A magnetic mono-component developer (magnetic toner) is carried on a developing sleeve as a developer carrying member, and a uniform toner layer is formed by a developer regulating member for regulating the layer thickness of the developer. This developing sleeve is brought into proximity to or contact with the photosensitive member. Then, for example, a developing bias voltage comprising an AC component and a DC component is applied to the developing sleeve to thereby generate a potential difference between the electrostatic image on the photosensitive member and the developing sleeve. Thereby, the toner is moved to the electrostatic image to thereby effect development.

Further describing, such a developing apparatus has a cylindrical developing sleeve rotatably provided in the opening portion of a developer container containing a magnetic toner therein. In this developing sleeve, there is provided magnetic field generating means (magnetic roller) provided with a plurality of magnetic poles and fixedly disposed. The magnetic toner is attracted onto the developing sleeve by a magnetic field generated by this magnetic field generating means, whereby the toner is carried on the developing sleeve and is conveyed. Also, in such a developing apparatus, a toner layer is formed on the developing sleeve by the developer regulating member abutting against the developing sleeve. As the developer regulating member, use is generally made of a blade-shaped member (hereinafter referred to as the "developing blade") formed of an elastic material.

On the other hand, there is the following method as another method using the dry type mono-component developing method. A nonmagnetic mono-component developer (nonmagnetic toner) is applied onto a developing roller as a developer carrying member by a supplying roller as a developer supplying member. The toner is carried on the developing roller and is conveyed and also, a toner layer is formed on the developing roller by the developer regulating member. This developing roller is brought into proximity to or contact with the photosensitive member to thereby effect development. At this time, a developing bias voltage similar to that mentioned above can be applied to the developing roller.

Further describing, such a developing apparatus has a developing roller rotatably provided in the opening portion of a developer container containing a nonmagnetic toner therein. Also, it has a supplying roller formed of a foam or the like and rotated while being in contact with the developing roller. The developing roller and the supplying roller are rotated in counter directions. The supplying roller has also the action of applying the nonmagnetic toner onto the developing roller and at the same time, scraping off the toner residual on the developing roller (hereinafter referred to as the "developing residual toner") after having passed a developing position.

In recent years, improvements in the resolution, sharpness, etc. of an image have been required and therefore, the toner used in the developing apparatus has been advanced in the tendency toward a spherical shape and a smaller particle diameter. Particularly, the toner made spherical has been used because it becomes higher in the charging amount Q [μC/g] per weight, and is effective for an improvement in the reproduction of a dot image and thin-line image, and is improved in transferability.

However, the use of the toner made spherical may pose the following problem.

A toner having a high degree of sphericity has the tendency that the toner conveyance amount M [$g/m^2$] passing the developing blade on the developing sleeve and conveyed to a developing area increases. This tendency appears during low coverage rate print (the output of an image low in image ratio) or after an idle rotating operation.

Also, there is a case where due to an excessive increase in the toner conveyance amount, variation in the distribution of the charging amount of the toner occurs to thereby cause unevenness of a toner coat on the developing sleeve, and uneven image density occurs.

Also, due to the increase in the toner conveyance amount, charge imparting to the toner is liable to become insufficient between the developing sleeve and the developing blade. There is also a case where the insufficient charged toner is conveyed to the developing area, whereby there occurs a so-called fogged image in which the toner adheres to other portion (non-image portion) than the electrostatic latent image on the photosensitive member.

It has been found that this tendency is particularly remarkable in a developing apparatus using a magnetic mono-component developer (magnetic toner). This is due largely to the fact that the toner is carried by the magnetic force of a magnet in the developing sleeve and therefore, there is not the action of scraping off the developing residual toner by the supplying roller as in a developing apparatus using a nonmagnetic mono-component developer (nonmagnetic toner).

That is, it is considered to be because the developing residual toner is not scraped off from the developing sleeve, but coats the developing sleeve together with a newly supplied toner and therefore there is a case where the toner coat becomes unstable.

As means for suppressing such an increase in. the toner conveyance amount M [$g/m^2$] as described above, heretofore chiefly the following techniques (α) to (γ) have been combined together, whereby control has been effected.

(α) The surface roughness [μm] of the developing sleeve is made small.

(β) The abutting pressure P [g/cm] of the developing blade against the developing sleeve is heightened.

(γ) The distance (hereinafter referred to as the "NE length") [mm] from the abutting position of the developing blade against the developing sleeve to the free end of the developing blade is shortened.

That is, the techniques (α) to (γ) are methods of mechanically regulating a toner conveying force and have a limit due to variation in manufacturing parts and variation in installation of parts. Also, an increase in the abutting pressure P [g/cm] increases mechanical stress given to the toner and promotes the deterioration of the toner, thus sometimes resulting in a reduction in image density. Also, when the surface roughness of the developing sleeve is set low, durability is reduced, and this becomes disadvantageous to the higher speed and longer life of the image forming apparatus.

There have been disclosed various techniques regarding a toner layer forming method by a developer regulating member.

There is a technique of prescribing the surface roughness Ra [μm] of a soft elastic member which is a developer layer forming member and the radius of curvature of a recess to thereby suppress the fluctuation of the toner conveyance amount for a long period of use (see Japanese Patent Application Laid-Open No. S62-242975).

Also, there is a technique of making the surface roughness of an elastic regulating member as a developer regulating member greater toward an upstream side relative to a downstream side with respect to the rotation direction of a developer carrying member to thereby give conveyance resistance to the toner and achieve the compatibility of stable layer thickness regulation and the uniform chargeability of the toner (see Japanese Patent Application Laid-Open No. H04-55872).

Also, there is a technique of designating the roughness of a layer forming member as a developer regulating member on the side thereof downstream of a position at which it abuts against a developer carrying member so as to be smaller than the roughness on the upstream side thereof, and/or forming a level difference shape on the side upstream of the abutting position (see Japanese Patent Application Laid-Open No. 2001-117356 and Japanese Patent Application Laid-Open No. 2001-117357). In these methods, the range prescription by the surface roughness Ra [μm] and/or the level difference height [mm] of the layer forming member is done.

Also, there is a technique of prescribing the surface roughness Rz of a thin layer forming blade as a developer regulating member to thereby increase the charging amount to a nonmagnetic mono-component developer (nonmagnetic toner) and achieve the prevention of a fogged image (see Japanese Patent Application Laid-Open No. H05-188748).

Also, there is a technique of prescribing the surface roughness Rz of a toner regulating member as a developer regulating member to thereby achieve the uniformization of the thin layer/an increase in the charging amount of a magnetic mono-component developer (magnetic toner), and achieve the higher quality of an image in the initial state of use (see Japanese Patent Application Laid-Open No. 2004-117919).

Also, there is a technique of providing streak-shaped unevenness at a pitch substantially parallel to a longitudinal direction on the surface of an elastic blade member as a developer regulating member and prescribing Rz to thereby achieve the maintenance of a stable toner charging amount for a long period of use (see Japanese Patent Application Laid-Open No. 2000-330376).

Also, there is a technique of prescribing the surface roughness Rz of a toner layer regulating member as a developer regulating member relative to the mean particle diameter of a toner to thereby utilize the clogging of toner particles on the rough surface of the toner layer regulating member (see Japanese Patent Application Laid-Open No. H09-080904). In this method, as described above, the toner particles are clogged to thereby enhance the degree of smoothness of the contact surface with a developing roller, and achieve the uniformization of the thin layer of the toner for a long period of use.

Also, there is a technique of prescribing the surface roughness Ra, Rz and Rmax of a developer regulating member to thereby achieve the uniformization of the thin layer of a toner on an elastic developing roller and the prevention of a faulty image after the elastic developing roller has been left unused for a long period of time (see Japanese Patent Application Laid-Open No. 2004-12542).

On the other hand, there is a proposition to contrive the formation of the uniform thin layer of a toner by controlling the coefficient of friction on the surface of a developer regulating member, instead of the surface shape (roughness) thereof as described above. That is, there is a technique of prescribing the magnitude relationships among the coefficients of friction of toners, the coefficients of friction of a layer thickness regulating member and the toner, and the coefficients of friction of a developing roller and the toner to thereby cause the toner layer to produce a shearing force, and achieve the formation of a thin layer of toner by a mechanical force (see Japanese Patent Publication No. H06-052448 and Japanese Patent Application Laid-Open No. 2000-227713).

Also, there is a technique of providing a charge uniformizing member discretely from a developer regulating member, and prescribing the magnitude relationship between the coefficients of kinetic friction thereof to thereby achieve the compatibility of the uniformized thin layer/uniform chargeability of a nonmagnetic mono-component toner (see Japanese Application Laid-Open No. 2000-275964).

Further, there is also a technique of providing a plurality of abutting members for a developer carrying member, and prescribing the magnitude relationship among the coefficients of friction thereof to thereby achieve the compatibility of the uniformized thin layer/uniform chargeability of a toner (see Japanese Patent Application Laid-Open No. 2002-023491).

However, it has been found that only by simply paying attention to Ra, Rz and Rmax regarding the surface roughness of the developer layer thickness regulating member as described above, it is difficult to achieve the compatibility of the stabilization of a developer layer thickness regulating force and the prevention of the occurrence of a streaked image.

Also, it has been found that only by prescribing the coefficient of surface friction of the developer layer thickness regulating member, it is difficult to achieve the compatibility of the stabilization of a toner regulating force and the prevention of the occurrence of a streaked image.

SUMMARY OF THE INVENTION

It is an object of the present invention to provide a developer regulating member and a developing apparatus which can stably effect developer layer thickness regulation on a developer carried on a developer carrying member.

It is an object of the present invention to provide a developer regulating member and a developing apparatus which can give a stable developer layer thickness regulating force to a developer carried on a developer carrying member.

It is another object of the present invention to provide a developer regulating member and a developing apparatus which can suppress a streaked image.

It is another object of the present invention to provide a developer regulating member and a developing apparatus which can prevent a developer conveyance amount on a developer carrying member from becoming excessive.

It is another object of the present invention to provide a developer regulating member and a developing apparatus which can make the charging amount of a developer on a developer carrying member proper.

It is another object of the present invention to provide a developer regulating member and a developing apparatus suitable for using a spherical developer.

Further objects and features of the present invention will become more apparent from the following detailed description when read with reference to the accompanying drawings.

DESCRIPTION OF THE PREFERRED EMBODIMENTS

A developer layer thickness regulating member and a developing apparatus according to the present invention will hereinafter be described in greater detail with reference to the drawings.

Embodiment 1

[General Construction and Operation of an Image Forming Apparatus]

Figure 1:
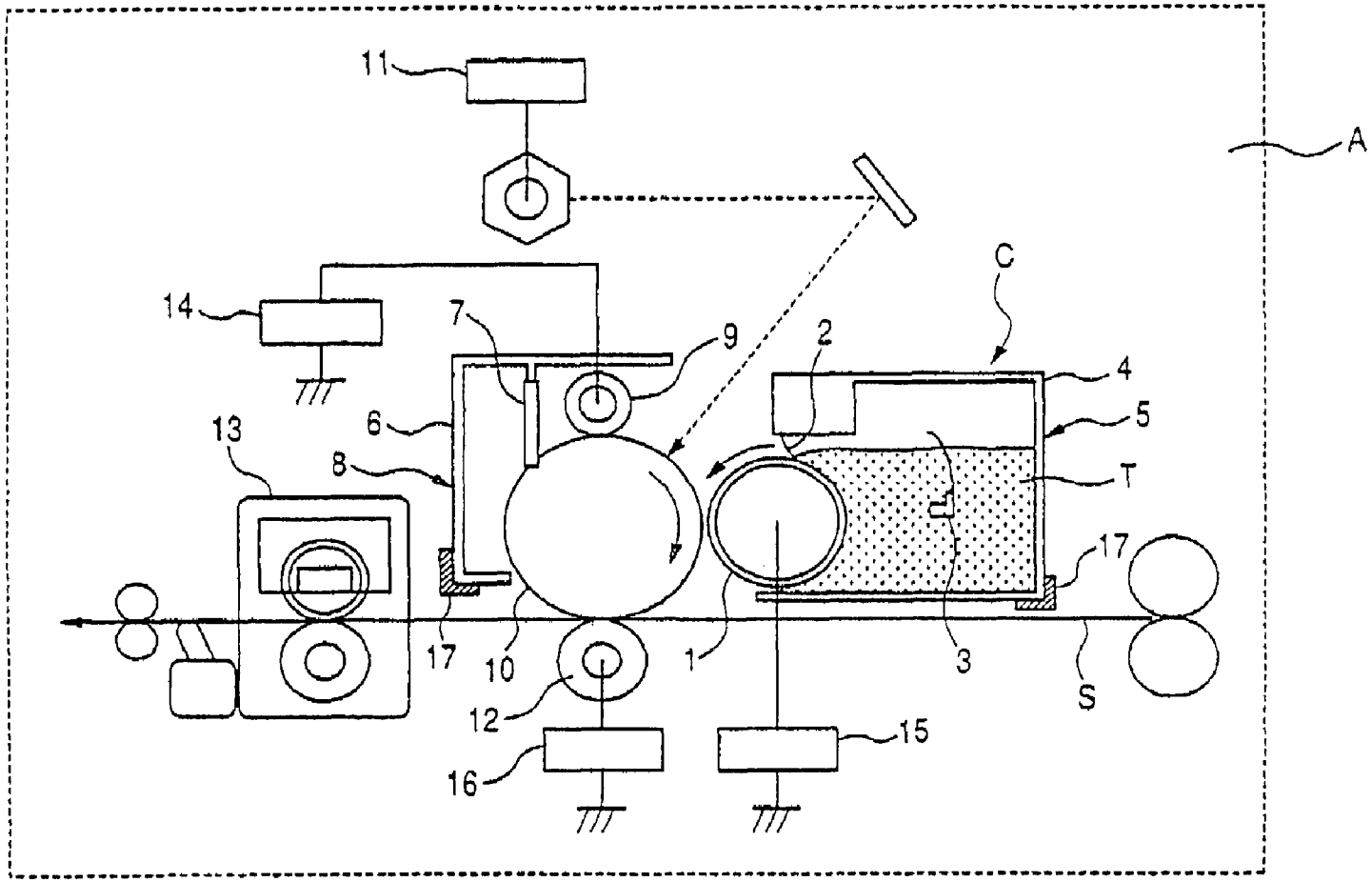
FIG. 1 is a cross sectional view schematically showing the construction of an embodiment of an image forming apparatus according to the present invention.

FIG. 1 is a cross-sectional view schematically showing the construction of an embodiment of an image forming apparatus according to the present invention. The image forming apparatus 100 according to the present embodiment is a laser beam printer which receives image information from a host computer, a network or the like, and forms an image on a recording material by an electrophotographic printing method in accordance with the image information and outputs the image.

The image forming apparatus 100 has a cylindrical electrophotographic photosensitive member (photosensitive member) 10 as an image bearing member. The photosensitive member 10 is rotatively driven in the direction indicated by the arrow (clockwise direction). Around the photosensitive member 10, there is disposed a charging roller 9 which is charging means for uniformly charging the photosensitive member 10. The charging roller 9 is rotated while being in contact with the photosensitive member 10. Around the photosensitive member 10, there is also disposed a developing apparatus 5 as developing means disposed in non-contact and opposed relationship with the photosensitive member 10. Around the photosensitive member 10, there is further disposed a cleaner 8 as cleaning means.

The developing apparatus 5, as will be described later in detail, has a developing sleeve 1 as a developer carrying member, a developing blade 2 as a developer regulating member, and a developer container 4 as a developer containing portion. A developer agitating and conveying member 3 is provided in the developer container 4. On the other hand, the cleaner 8 has a cleaning blade 7 as a cleaning member, and a waste toner container 6 for containing therein a waste toner removed from the photosensitive member 10 by the cleaning blade 7.

In the present embodiment, the photosensitive member 10, the charging roller 9 as process means acting on the photosensitive member 10, the developing apparatus 5 and the cleaner 8 are integrally constructed as a process cartridge C. The process cartridge C is detachably mountable to an image forming apparatus main body (apparatus main body) A in a predetermined manner.

That is, the apparatus main body A has mounting means 17 comprising a positioning member for positioning the process cartridge C in the apparatus main body A, and a guide member for guiding the process cartridge C into the apparatus main body A. The process cartridge C is detachably mounted to the apparatus main body A through the mounting means 17.

Also, the apparatus main body A of the image forming apparatus 100 has a laser scanner 11 as exposing means for applying a laser beam correspondingly to the image information, above the process cartridge C in FIG. 1. Also, below the process cartridge C in FIG. 1, a transfer roller 12, which is transferring means, is disposed at a location opposed to the photosensitive member 10. Also, a heat fixing device 13 which is fixing means is disposed downstream of the transfer roller 12 with respect to the movement direction of a recording material S.

The apparatus main body A of the image forming apparatus 100 further has a charging bias voltage source 14 as charging bias voltage applying means for applying a charging bias voltage to the charging roller 9 during image formation. Also, the apparatus main body A of the image forming apparatus 100 has a developing bias voltage source 15 as developing bias voltage applying means for applying a developing bias voltage to the developing sleeve 1 during image formation. Also, the apparatus main body A of the image forming apparatus 100 has a transferring bias voltage source 16 as transferring bias voltage applying means for applying a transferring bias voltage to the transfer roller 12 during image formation.

During an image forming operation, the photosensitive member 10 is rotatively driven in the direction indicated by the arrow in FIG. 1. The surface of the photosensitive member 10 being rotated is uniformly charged by the charging roller 9 having the charging bias voltage applied thereto by the charging bias voltage source 14. Subsequently, the charged surface of the photosensitive member 10 is scanned by and exposed to the laser beam applied from the laser scanner 11. Thereby, an electrostatic image (latent image) is formed on the photosensitive member 10.

The electrostatic image formed on the surface of the photosensitive member 10 has a toner T caused to adhere thereto by the developing apparatus 5, and is visualized as a toner image. At this time, the developing bias voltage which is a voltage comprising a DC voltage and an AC voltage superimposed one upon the other is applied to the developing sleeve 1 of the developing apparatus 5 by the developing bias voltage source 15. By the action of this developing bias, the toner is shifted from the developing sleeve 1 to the electrostatic image formed on the photosensitive member 10.

Next, the recording material S is conveyed from a recording material supplying portion (not shown) provided with a sheet supplying cassette or the like to a transferring portion in which the photosensitive member 10 and the transfer roller 12 contact with each other. The toner image on the photosensitive member 10 is transferred to the surface of the recording material conveyed while being nipped between the photosensitive member 10 and the transfer roller 12 with constant pressure. At this time, the transferring bias voltage of a polarity opposite to the regular charging polarity of the toner is applied to the transfer roller 12 by the transferring bias voltage source 16. The toner on the photosensitive member 10 receives the action of this transferring bias, whereby it is transferred onto the recording material S.

Further, the recording material S to which the toner image has been transferred is conveyed to the heat fixing device 13. The recording material S is heated and pressurized in the heat fixing device 13, whereby the toner image is fixed as a permanent image on the surface of the recording material S. Thereafter, the recording material S is discharged to the outside of the apparatus main body A.

While in the present embodiment, the cartridge detachably mountable to the main body of the image forming apparatus is the process cartridge C comprising the photosensitive member 10, the charging roller 9, the developing apparatus 5 and the cleaner 8 integrally made into a cartridge, this is not restrictive. For example, the process cartridge can be at least the photosensitive member and the developing means integrally made into a cartridge. In addition, the process cartridge may have at least one of the charging means and the cleaning means. Further, the cartridge detachably mountable to the main body of the image forming apparatus may be a developing cartridge in which the developing apparatus is singly made detachably mountable to the main body of the image forming apparatus.

[Developing Apparatus]

Figure 2:
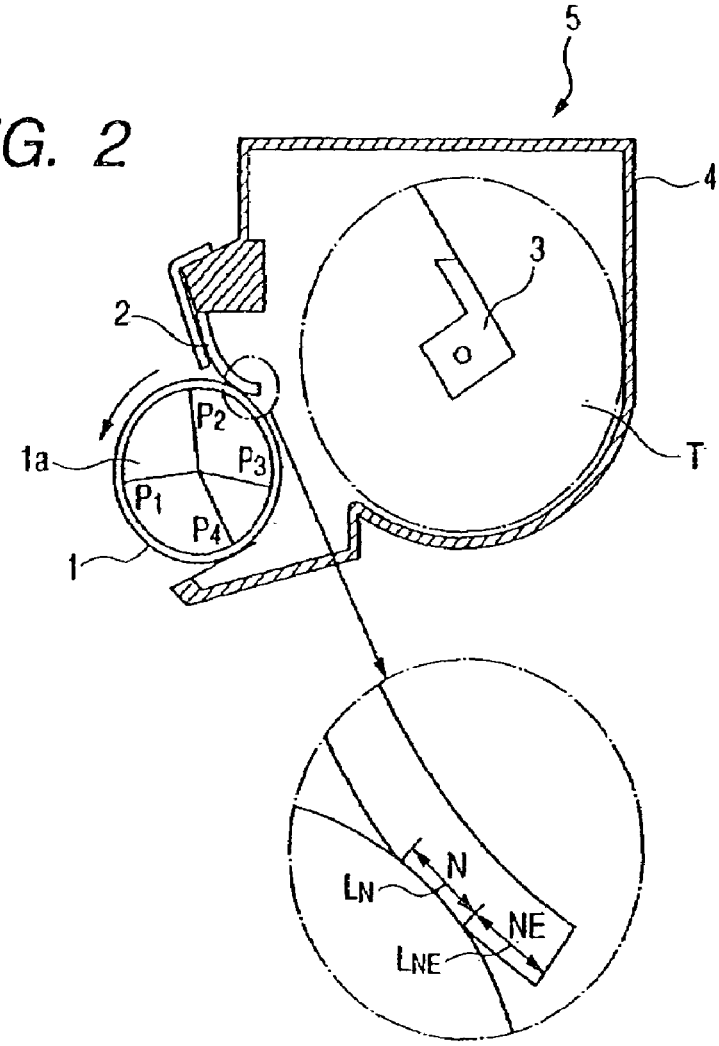
FIG. 2 is a cross-sectional view schematically showing the construction of an embodiment of a developing apparatus according to the present invention.
Figure 3:
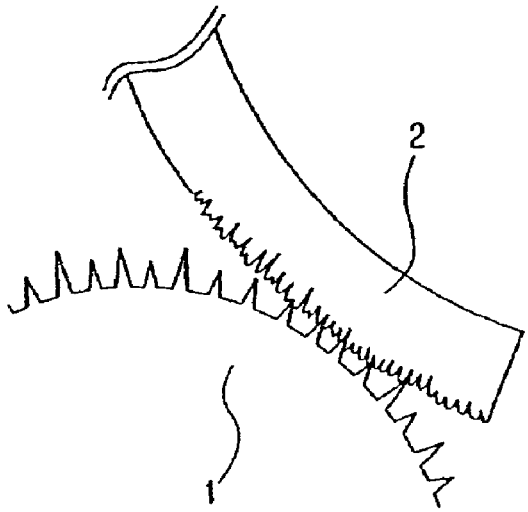
FIG. 3 is a pattern view exaggeratingly showing the surface shape in the contact portion (blade nip portion) between a developer layer thickness regulating member and a developer carrying member.

Reference is now had to FIGS. 2 and 3 to describe the construction of the developing apparatus 5 in the present embodiment in greater detail. FIG. 2 shows the cross-sectional construction of the developing apparatus 5 in detail. Also, FIG. 3 exaggeratingly shows the surface shapes of the developing sleeve 1 and the developing blade 2.

The developing apparatus 5 in the present embodiment contains a magnetic mono-component developer, i.e., a magnetic toner T, as a developer in the developer container 4 as the developer containing portion In the present embodiment, the regular charging polarity of the toner T is the negative polarity. Also, the developing sleeve 1 as the developer carrying member is rotatably disposed in the opening portion of the developer container 4 which is opposed to the photosensitive member 10. Also, in the developer container 4, there is provided the agitating and conveying member 3 for agitating the toner T contained in the developer container and conveying it to the developing sleeve 1.

In the present embodiment, the developing sleeve 1 comprises a cylindrical aluminum blank tube having a diameter of 20 [mm] and an electrically conductive resin layer having volume resistance of $10^{-2}$ to $10^{4}$ [Ωcm] formed thereon. Also, as the developing sleeve 1, use can be made of one having moderate irregularities on the surface thereof in order to heighten the probability of frictional contact with the toner T. More specifically, as the developing sleeve 1, use can preferably be made of one having an uneven surface having surface roughness Ra of 0.5 to 2.0 [μm]. Here, the surface roughness Ra is arithmetic mean roughness (center-line mean roughness) [μm] prescribed by JIS-B0601-1994. That is, the developing sleeve 1 may preferably be such that the surface roughness parameter thereof satisfies the condition that 0.5 [μm]≦Ra≦2.0 [μm]. When the surface roughness of the developing sleeve 1 is made great, the toner conveyance amount M becomes great, but as will be described later in detail, according to the developing blade 2 in the present embodiment, the toner can be suppressed from coating excessively and stable toner layer thickness regulation can be effected.

A magnet roller 1*a* as magnetic field generating means for generating a magnetic field is fixedly disposed against rotation in the developing sleeve 1. As shown in FIG. 2, the magnet roller 1*a* has a plurality of magnetic poles P1, P2, P3 and P4 in the circumferential direction thereof.

The toner T conveyed by the agitating and conveying member 3 is attracted by the magnetic force of the introducing magnetic pole P3 of the magnet roller 1*a* and is introduced onto the developing sleeve 1. In the present embodiment, the magnetic flux density G of the introducing magnetic pole P3 at the surface position of the developing sleeve 1 is set to 60 to 80 [mT].

The developing apparatus 5 has the developing blade 2 as a developer regulating member for regulating the layer thickness of the toner layer on the developing sleeve 1. The developing blade 2 can be formed of a rubber material such as urethane or silicone as an elastic member. The developing blade 2 is provided with a supported portion supported by a support member of a metal or the like. In the present embodiment, the developing blade 2 has its free end turned toward an upstream side (counter direction) with respect to the rotation direction of the developing sleeve 1 and abuts against the surface of the developing sleeve 1 by the side thereof near the free end. That is, the developing blade 2 has its free end provided more upstream with respect to the rotation direction of the sleeve than the supported portion.

In the present embodiment, the developing blade 2 is caused to abut against the developing sleeve 1 under the condition that the abutting pressure P=10 to 50 [g/cm]. The abutting pressure P was measured by the following method. Three SUS sheets (having a thickness of 50 μm and a width w [cm] are inserted into the abutment nip between the developing sleeve 1 and the developing blade 2 in a state free of the toner, and the spring pressure F [gf] when the middle sheet is pulled out is measured. Also, the coefficient of friction μ between adjacent ones of the SUS sheets is measured. Then, the abutting pressure (line pressure) P=μF/w is found.

In the present embodiment, the distance (hereinafter referred to as the "NE length") $L_{NE}$ from the contact portion (hereinafter referred to as the "blade nip portion") N between the developing sleeve 1 and the developing blade 2 to the free end of the developing blade 2 is set to $L_{NE}$=0.1 to 3.0 [mm]. More specifically, the NE length, as shown in the enlarged view of FIG. 2, is the length from the upstream end portion of the blade nip portion N with respect to the movement direction of the surface of the developing sleeve 1 to the free end of the developing blade 2. As shown in FIG. 2, the blade surface on which the supported portion of the developing blade 2 which is supported by the support member is provided can be located on the same side as the blade surface on the same side as the blade surface on which the contact portion N of the developing blade 2 is provided. However, the blade surface of the supported portion and the blade surface of the contact portion N may be located on opposite sides.

As will be described later in detail, at least that portion of the developing blade 2 which corresponds to the blade nip portion N is made into a rough surface. Also, it is preferable that the width (hereinafter referred to as the "blade nip width") $L_N$ of the blade nip portion N in the movement direction of the surface of the developing sleeve 1 be 0.4 [mm] or greater. Thereby, the action of the roughened surface shape of the developing blade 2 to developer regulation can be made more effective. If the nip width $L_N$ is set to a value smaller than 0.4 [mm], the effect of the developing blade 2 having been made into a rough surface is liable to become small. The contact width of the developing blade 2 with the developing sleeve 1 can be secured to thereby effect stable toner layer regulation. In a construction wherein the elastic member as the developing blade 2 is flexed and is caused to abut against the developing sleeve 1, the nip width $L_N$ is determined by the hardness of the flexure fulcrum thereof, etc. However, for the reason that the enlargement of the nip width is limited, it is usually preferable that the nip width $L_N$ be 2.0 [mm] or less.

The NE length and the nip width were found by enlarging and observing the abutting surface of the developing blade 2 after an image has been outputted, through a microscope, and measuring the length of an area to which the toner adheres.

Also, in the present embodiment, the developing bias voltage applied to the developing sleeve 1 by the developing bias voltage source 15 during image formation is a rectangular wave bias voltage comprising an AC component (peak-to-peak voltage: 1600 [V], frequency: 2000 [Hz]) and a DC component (−400 [V]) superimposed one upon the other. By the developing bias voltage, an alternating electric field is formed for the dark portion potential and light portion potential of the photosensitive member.

Description will now be made of the magnetic monocomponent developer i.e., the magnetic toner T, used in the present embodiment.

In the present embodiment, the magnetic toner T is such that the main component of the binding resin thereof comprises a styrene acryl copolymer. Magnetic iron oxide particles, wax and a charge control agent are mixed with the biding resin, and the mixture is melted and kneaded. The cooled mixture is roughly crushed by a hammer mill, and the obtained roughly crushed material is finely crushed. Then, the obtained finely crushed powder was classified by a classifier to thereby produce classified powder. Further, the process of making the surface spherical was effected on the obtained classified powder. Thereby, there were obtained negatively chargeable magnetic toner particles having a weight mean particle diameter of 6.5 [μm]. 1.3 parts by mass of hydrophobic silica fine powder material was extraneously added to and mixed with 100 parts by mass of obtained toner particles to thereby prepare the magnetic toner T.

Here, description will be made of the measurement of the mean particle diameter and the degree of circularity of the toner.

First, the grain size distribution of the toner can be measured by one of various known methods. Herein, the mean particle diameter of the toner was measured by the use of COULTER COUNTER Multisizer™ II type (100 μm aperture) produced by COULTER K.K. This is a method of measuring the volume and number of particles of the developer and calculating the volume distribution and the distribution of number of particles to thereby fixed the weight mean particle diameter of the weight standard obtained from the volume distribution. The percentage of the number of toner particles having a particle diameter of 4 μm or less was found from the number of toner particles corresponding to an object particle diameter in the distribution of number of particles. In the present embodiment, use was made of a toner in which the amount of fine powder toner (percentage of the number of particles) having a weight mean particle diameter of 6.5 [μm] and a particle diameter of 4 μm or less is 20 [%].

Next, the degree of circularity of the toner can be represented by the use of a mean degree of circularity as a method simple for quantitatively expressing the shape of a particle. Herein, measurement was effected by the use of a flow type particle image analyzing apparatus FPIA-1000 produced by Toa Medical Electronics Co., Ltd. The degree of circularity of the measured particle is found by the following expression (A):

$$\text{Degree of circularity } a = L_0/L_1, \quad \text{(A)}$$

Where $L_0$ indicates the circumferential length of a circle having the same projection area as a particle image, and $L_1$ indicates the circumferential length of the particle image.

Further, as shown in the following expression (B), the value obtained by dividing the sum total of the degrees of circularity of all measured particles by the number of all particles is defined as the mean degree of circularity.

$$b = \sum_{i=1}^{m} ai/m, \quad \text{(B)}$$

where b: the mean degree of circularity, ai: the degree of circularity, and m: the number of measured particles.

If the present invention is applied to a toner of which the mean degree of circularity is 0.940 or greater, the effect of toner layer thickness regulation can be employed more effectively. Also, as the toner particle diameter, use can preferably be made of a range of weight mean particle diameter within 5.0 to 8.0 μm. That is, as will be described later in detail, according to the developing blade 2 in the present embodiment, even when use is made of a magnetic mono-component developer (magnetic toner) made spherical, stable toner layer thickness regulation can be effected to thereby obtained an image of high quality.

[Developing Blade]

The developing blade 2 in the present embodiment will now be described in greater detail.

In the present embodiment, as the material of the developing blade 2, use is made of polyurethane rubber which is a material excellent in wear resistance, small in permanent strain and relatively inexpensive. The hardness of the rubber may preferably be a range of 55° to 85° in terms of JIS-A hardness.

This polyurethane rubber is manufactured by heat-hardening-reacting a polyisocianate compound, high-molecular polyole and a hardening agent. A method of manufacturing a sheet of urethane rubber (urethane sheet) forming the developing blade 2 in the present embodiment is not particularly restricted, but use can be made of a centrifugal molding method using a drum-shaped metal mold, or a method of molding by injection into a metal mold.

In the present embodiment, it may be mentioned as a feature that the metal mold surface side of the urethane sheet formed by the above-mentioned molding method is used as the abutting surface of the developing blade 2 against the developing sleeve 1. In the centrifugal molding method, the metal mold is rotated at the step of pouring polyurethane forming liquid (urethane forming liquid) into the metal mold, and heat-hardening it while rotating the metal mold and therefore, a centrifugal force works. Therefore, the air or the like in the urethane forming liquid goes out to the inside, and the urethane forming liquid is urged against the metal mold surface and is hardened. As the result, without the mixing of the air or the like, there can be obtained a urethane sheet to which the unevenness of the metal mold surface has been transferred.

When a smooth surface was to be brought into abutment against the developing sleeve 1, the non-metal mold surface side capable of obtaining a uniformly smooth surface was used as the abutting surface against the developing sleeve 1. Therefore, the unevenness formed on the metal mold surface can be a shape taking the mold releasability of the urethane sheet into account. Accordingly, heretofore, the uneven shape of the surface of the metal mold was not particular.

To obtain the surface shape of the developing blade 2 in the present embodiment the surface roughness of the inner peripheral surface of the metal mold is controlled in detail.

As a method of forming the irregularities of the inner peripheral surface of the metal mold, use can preferably be made of a method of applying bead blast to the metal mold surface by spherical particles. Also, as the foregoing method of forming the irregularities, use can preferably be made of a method of providing a mold releasing layer on the inner peripheral surface of the metal mold, and causing the surface layer portion of the mold releasing layer to contain a surface roughening process agent (spherical particles) such as spherical graphite fluoride. According to these methods, the height (depth) and spacing of profile irregularities of the irregularity portion can be controlled by the kind, particle diameter and dispersion condition of the particles to thereby make a proper shape.

Figure 4:
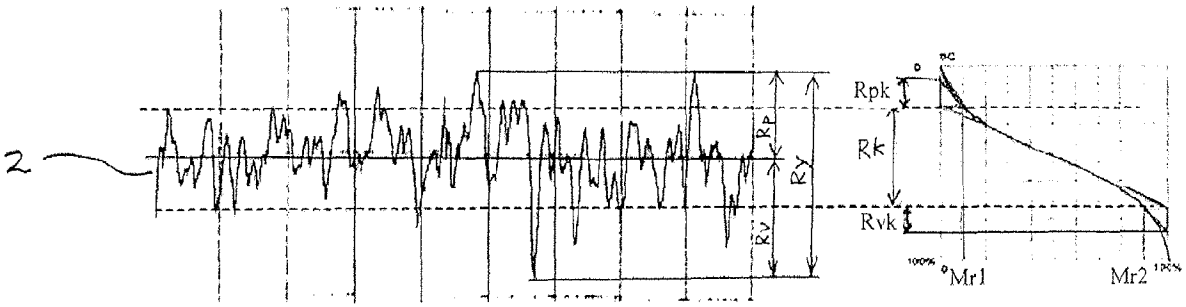
FIG. 4 is a pattern view of the surface of a developing blade prepared by the use of a metal mold subjected to bead blasting.

For example, FIG. 4 shows an example of the surface of a urethane sheet prepared by transferring from a metal mold to which bead blast was applied. In this method, the kind and discharging condition of blast particles can be adjusted to thereby make convex portions into an arcuate shape bearing smooth roundness, and uniformize the height of the convex portions and yet control the rate (percentage) and depth (height) of concave portions.

Figure 5:
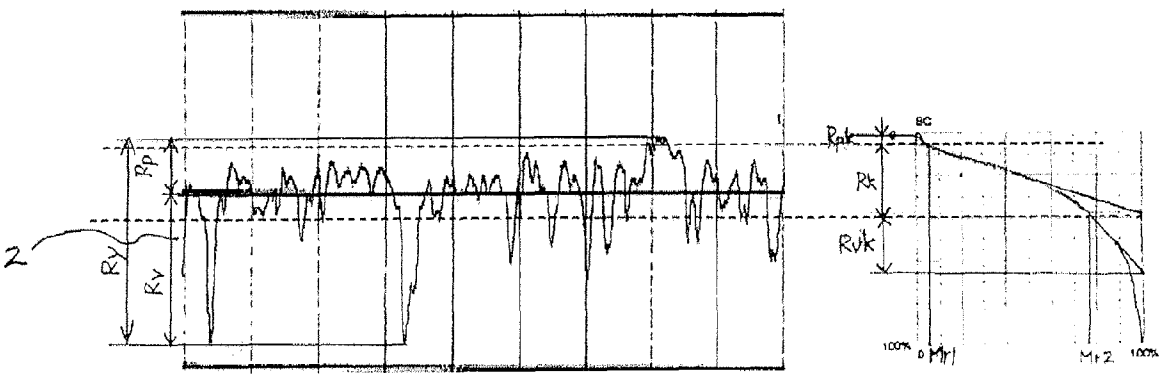
FIG. 5 is a pattern view of a developing blade prepared by the use of a metal mold having had its mold releasing layer roughened.

On the other hand, FIG. 5 shows an example of a urethane sheet made by being transferred from a mold releasing layer containing a surface roughening process agent formed on the metal mold surface. In this method, the convex portions assume a relatively flat shape, and the concave portions can obtain a relatively deep surface shape. Also, in this method, the kind and dispersion condition of the surface roughening process agent can be adjusted to thereby control the rate (percentage) and depth (height) of the concave portions and the convex portions.

Then, the developing blade 2 is constructed so that the uneven surface (metal mold surface) of the urethane sheet obtained in the above-described manner may be the contact surface side with the developing sleeve 1. Thereby, the layer thickness regulation of the toner is effected.

The surfaces of the urethane sheets shown in FIGS. 4 and 5 are shown at a ratio of about 1:40 in lengthwise and breadthwise directions (length and breadth). FIG. 4 shows the surface shape of a rubber sheet member to which the shape of the roughened surface of the metal mold has been transferred, and FIG. 5 shows the surface shape of a rubber sheet member to which the shape of the mold releasing process layer has been transferred.

Description will now be made of the surface roughness parameter of that portion of the developing blade 2 which corresponds to the blade nip portion N to which attention is paid in the present invention.

The surface roughness parameter of the developing blade 2 was measured under the following conditions by the use of a contact type surface roughness measuring machine SE3500 (produced by Kosaka Research Institute, Ltd.) so as to include the contact position between the developing blade 2 and the developing sleeve 1.

Reference length: 0.8 [mm]

Evaluated length: 4.0 [mm]

Feeding speed: 0.1 [mm]

Filter: Gauss

Figure 6A:
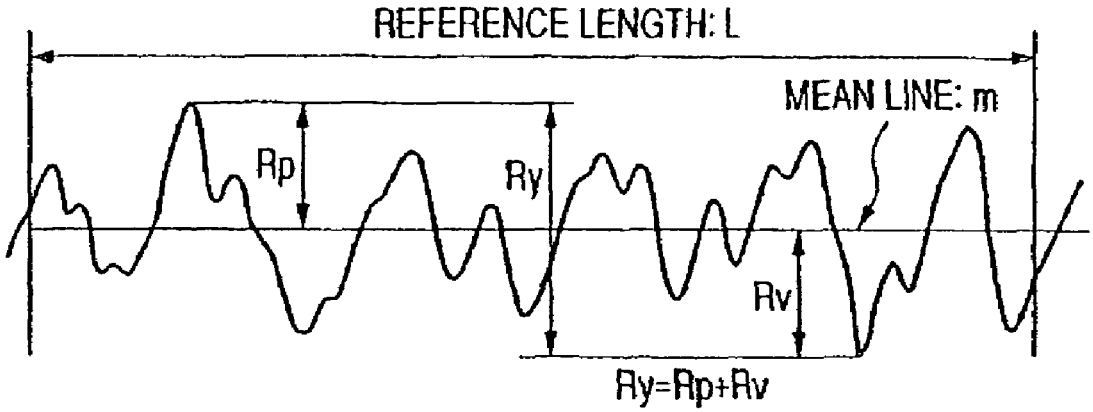
FIG. 6A is a roughness curve graph for illustrating surface parameters Rp and Ry.
Figure 6B:
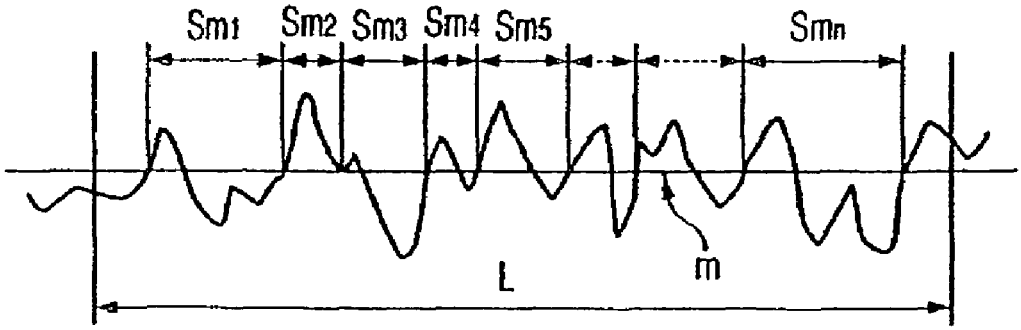
FIG. 6B is a roughness curve graph for illustrating a surface roughness parameter Sm.

FIGS. 6A and 6B are surface roughness profile views for illustrating the roughness parameter.

Rp is a maximum profile peak height (the depth of the center line) [μm] prescribed by ISO4287-1997.

Sm is the mean spacing [mm] of profile irregularities prescribed by JIS-B0601-1994.

Rz is the ten-point mean roughness [μm] prescribed by JIS-B0601-1994.

Ry (Rmax) is a maximum height [μm] prescribed by JIS-B0601-1994.

Figure 7A:
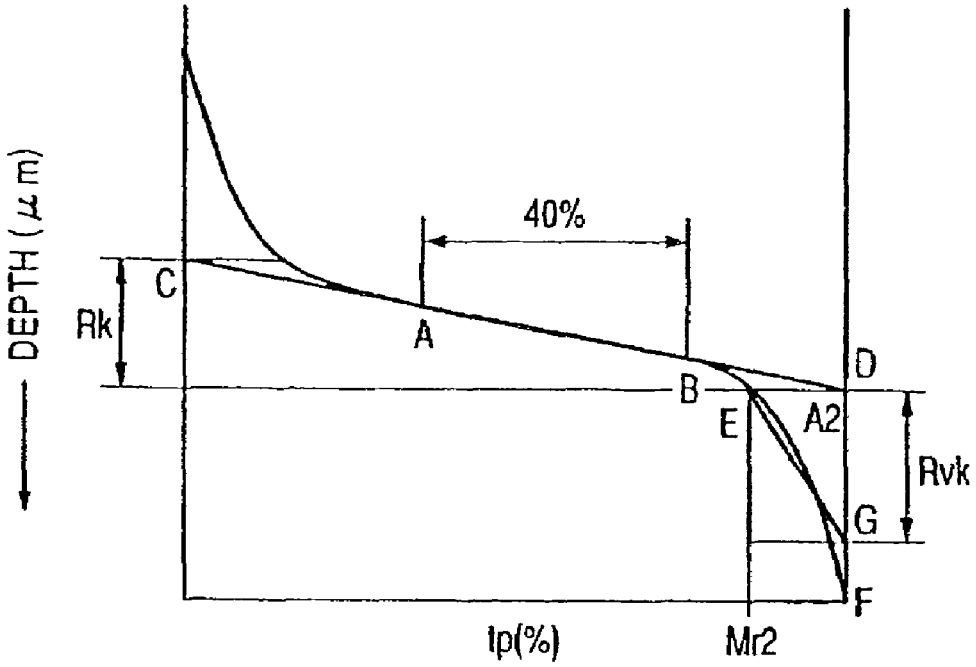
FIG. 7A is a bearing curve graph for illustrating surface roughness parameters Rvk and Mr2.
Figure 7B:
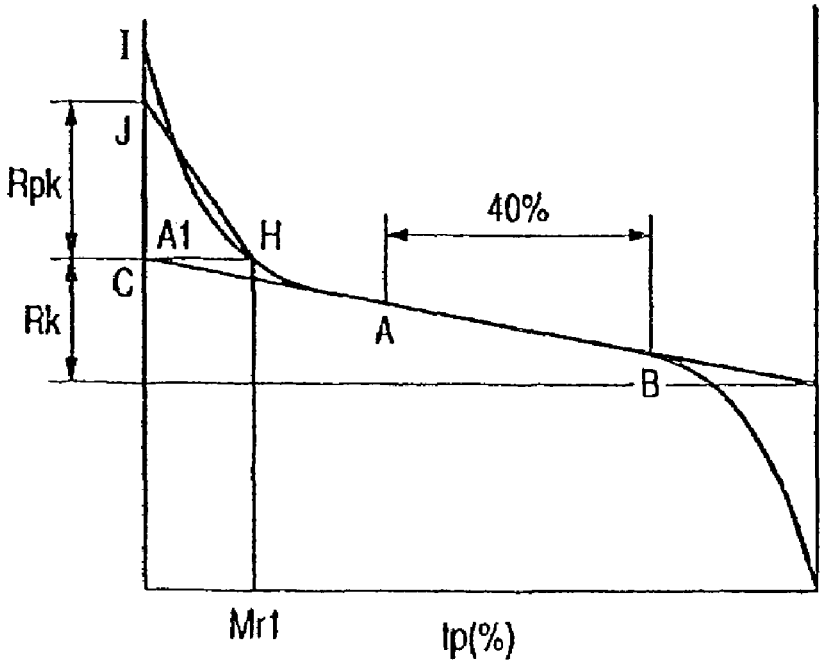
FIG. 7B is a bearing curve graph for illustrating a surface roughness parameter Rpk.

FIGS. 7A and 7B are bearing curve graphs for illustrating another surface roughness parameter.

This bearing curve has as the axis of abscissas the ratio (relative bearing length tp) [%] between the sum of the segment of a section cut by a line of a certain height (depth) [μm] parallel to a mean line in the reference length L and the reference length L. Also, this bearing curve has the height (depth) [μm] in the depth direction as the axis of ordinates.

One of straight lines passing through two points (point A and point B) on the bearing curve in which the difference between the tp values of the points A to B is 40% and which is smallest in inclination is found. The points of intersection between this straight line and tp 0% and tp 10% are defined as a point C and a point D. Also, points on the bearing curve at tp 0% and tp 100% are defined as a point I and a point F, respectively. The depth from the point C to the point D is defined as the level difference Rk of a roughness core. The point of intersection between a cutting level line passing through the point D and the bearing curve is defined as a point E. Such a point G on tp 100% that at this time, the area surrounded by a segment DE, a segment DF and a curve EF and the area of a triangle DEG become equal to each other is found. The distance between the point D and the point G is defined as Rvk, and the tp value of the point E is defined as Mr2. Also, the point of intersection between a cutting level line passing through the point C and the bearing curve is defined as a point H. Such a point J on tp 0% that at this time, the area surrounded by a segment CH, a segment CI and a curve HI and the area of a triangle CHJ become equal to each other is found. The distance between the point C and the point J is defined as Rpk, and the tp value of the point H is defined as Mr1.

Here, Rpk is an initial wear height (the height of a peak off the level difference Rk of the roughness core) [μm].

Rvk is an oil retaining depth (the depth of a valley off the level difference Rk of the roughness core) [μm].

Mr2 is a profile bearing length ratio (profile bearing length ratio corresponding to the lower limit value of the level difference Rk of the roughness core) [%].

A2 is defined as an oil retaining area represented by the following expression.

$$A2 = Rvk \times (100 - Mr2)/100$$

These surface roughness parameters Rpk, Rvk, Mr2 and A2 are prescribed by DIN4776. DIN is the German Industrial Standard established by Deutsches Institut fur Normunge V.

Now, one of the objects of the present invention is to enable stable toner layer thickness regulation to be effected by an inexpensive method while suppressing a streaked image. One of the more articular objects of the present invention is to prevent the occurrence of a streaked image to thereby enable stable toner layer thickness regulation to be effected for a long period by an inexpensive method even when a toner having a high degree of circularity is used.

So, the following become the points.

(1) To a Toner Layer Thickness Regulating Force (Suppressing Force for the Toner Conveyance Amount):

It is effective to make the capacity of the convex portions of the surface of the developing blade 2 large to thereby generate conveyance resistance to the toner T. It has been found that this is greatly related to the oil retaining area A2. That is, it becomes a point that the area ratio of the valley off the roughness core is a predetermined value or greater.

Also, Sm has a proper range. When the capacity of the concave portions is small, the effect of regulating the conveyance of the toner becomes small if Sm is great. On the other hand, if Sm is too small, the conveyance resistance of the toner T is considered to become small. According to our studies, a good result was obtained when Sm was 0.03 [mm] or greater. Also, by the above-described manufacturing method, it was difficult to make a developing blade 2 in which Sm was 0.03 [mm] or less.

(2) To a streaked image:

It has been found that by making the height of the convex portions of the surface of the developing blade 2 small, it becomes possible to prevent the occurrence of the streaks of the toner coat on the developing sleeve 1 without disturbing the toner coat. It is necessary to make Rpk and Rp smaller than respective predetermined values. Also, it is necessary to make Sm smaller than a predetermined value. If Sm is too great, the toner coat on the developing sleeve 1 will be disturbed to thereby cause streaks.

That is, it is a feature of the present invention to obtain such a surface shape of the developing blade 2 in which items (1) and (2) above are compatible.

Description will hereinafter be made of some experimental examples. It should be understood that the following experimental examples are provided to make the present invention readily understood, and the present invention is not intended to be restricted to specific constructions described hereinafter.

EXPERIMENTAL EXAMPLE 1

In the image forming apparatus 100 having the above-described construction, printing was actually effected with the degree of circularity of the toner T and the setting regarding the developing blade 2 changed variously. The results of image evaluation and the measurement of the toner conveyance amount (toner coat amount) M [g/m$^2$] and the toner charging amount Q [μC/g] are shown in Table 1 below.

The image forming apparatus (laser beam printer) 100 used is capable of outputting 30 sheets within one minute, and the rotational speed of the developing sleeve 1 was 200 [mm/sec.]. As the image evaluation, the following were effected.

(i) Observation of uneven image density (uneven image) in continuously print-outputted halftone images (600 dpi, coverage rate 80%) and the uneven toner coat (uneven coat) on the developing sleeve 1

(ii) Observation of the longitudinal streaks (streaks in the conveying direction of the recording material: streaked images) of the same halftone images and the longitudinal streaks of the toner coat on the developing sleeve 1 (streaks in the rotation direction of the developing sleeve 1: coat streaks)

The foregoing evaluation was effected with 10,000 sheets printed under a low-temperature low-humidity environment (15° C./10%). Also, the toner conveyance amount M [g/m$^2$] and the toner charging amount Q [μC/g] on the developing sleeve 1 were measured in the following manner. In a state after a solid white image (image of coverage rate of 0%) was printed, the toner on the developing method. The picked toner was measured by the use of an electrometer 6514 produced by Keithley Co., Inc. That is, the weight M [g/m$^2$] of the picked toner to the area of the toner picking surface on the developing sleeve 1, and the charge amount Q [μC/g] to the weight of the picked toner were measured. Also, image density was measured by the use of a Macbeth reflection densitometer (RD918).

In the range of the present embodiment, the greater is Q/M, the better becomes the quality of image such as dot reproduction, the sharpness of a line image, etc.

TABLE 1

| | Blade surface roughening | Mean degree of circularity of toner | P [g/cm] | $L_{NE}$ [mm] | -Q [μC/g] | M [g/m$^2$] | Uneven image | Streaked Image |
|---|---|---|---|---|---|---|---|---|
| Specific Example 1-1 | present | 0.962 | 25 | 1.5 | 6.0 | 15 | ○ | ○ |
| Specific Example 1-2 | Present | 0.962 | 15 | 1.5 | 5.0 | 18 | ○ | ○ |
| Specific Example 1-3 | Present | 0.962 | 25 | 3.0 | 6.0 | 18 | ○ | ○ |
| Specific Example 1-4 | present | 0.942 | 25 | 1.5 | 4.8 | 15 | ○ | ○ |
| Specific Example 1-5 | present | 0.935 | 25 | 1.5 | 3.0 | 15 | ○ | ○ |
| Specific Example 1-6 | present | 0.925 | 25 | 1.5 | 3.0 | 15 | ○ | ○ |
| Specific Example 1-7 | present | 0.972 | 25 | 1.5 | 6.0 | 17 | ○ | ○ |
| Compaxative Example 0-1 | absent | 0.962 | 25 | 1.5 | 4.0 | 24 | X | ○ |
| Comparative Example 0-2 | absent | 0.962 | 15 | 1.5 | 2.5 | 26 | X | ○ |
| Comparative Example 0-3 | absent | 0.962 | 25 | 3.0 | 2.8 | 27 | X | ○ |
| Comparative Example 0-4 | absent | 0.942 | 25 | 1.5 | 3.5 | 22 | X | ○ |
| Comparative Example 0-5 | absent | 0.935 | 25 | 1.5 | 3.0 | 15 | ○ | ○ |
| Comparative Example 0-6 | absent | 0.925 | 25 | 1.5 | 3.0 | 15 | ○ | ○ |
| Comparative Example 0-7 | absent | 0.972 | 25 | 1.5 | 4.0 | 25 | X | ○ |

COMPARATIVE EXAMPLE 0

Description will first be made of the result when the surface of the developing blade 2 is smooth. The surface shape of the developing blade 2 used at this time can be represented by a surface roughness parameter described as Comparative Example 0 in Table 2 showing the result of Experimental Example 2 below.

COMPARATIVE EXAMPLE 0-1

As the developing blade 2, use was made of a developing blade 2 not subjected to the surface roughening process. In the other points, the same condition as that in the present embodiment was adopted. As the toner T, use was made of a magnetic toner T of which the mean degree of circularity is 0.962. In this case, it becomes easy for the toner to pass through the blade nip portion and therefore, the toner conveyance amount increases. As the result, variation in the charging amount distribution of the toner T occurred, and uneven coat occurred and uneven image occurred. Also, the imparting of charge to the toner became insufficient due to the increase in the toner conveyance amount and therefore, dot reproduction was bad.

COMPARATIVE EXAMPLE 0-2

When the contact pressure P [g/cm] between the developing blade 2 and the developing sleeve 1 was small, the toner conveyance amount further increased and the uneven coat and the dot reproduction were deteriorated.

COMPARATIVE EXAMPLE 0-3

When the NE length $L_{NE}$ [mm] of the developing blade 2 was great, the toner conveyance amount further increased, and the uneven coat and the dot reproduction were deteriorated.

COMPARATIVE EXAMPLES 0-4 to 0-7

These are examples in which in the construction of Comparative Example 0-1, the degree of circularity of the toner T was changed as a parameter. Regarding a toner T of which the mean degree of circularity is smaller than 0.940, the toner coat amount tends to be stabilized even if a developing blade 2 not subjected to the surface roughening process is used.

Also, when the contact pressure P [g/cm] between the developing blade 2 and the developing sleeve 1 was set high, the NE length $L_{NE}$ [mm] of the developing blade was set short, or the surface roughness Ra [μm] of the developing sleeve 1 was set small, the toner conveyance amount tended to be suppressed. However, the deterioration of the toner T was promoted, and a reduction in image density after a long period of use occurred.

SPECIFIC EXAMPLE 1

Description will now be made of the result in a case (the present embodiment) where the surface of the developing blade was subjected to the surface roughening process.

SPECIFIC EXAMPLE 1-1

Use was made of a developing blade 2 subjected to the surface roughening process in accordance with the present embodiment. As the toner T, use was made of a magnetic toner T of which the mean degree of circularity is 0.962. In this case, the surface of the developing blade 2 was subjected to the surface roughening process, whereby the toner conveyance process, whereby the toner conveyance amount could be made proper. The surface shape of the developing blade 2 used at this time can be represented by a surface roughness parameter described in Table 2 showing the result of Experimental Example 2 below.

SPECIFIC EXAMPLE 1-2

Evaluation was effected under the same condition as Specific Example 1-1 above with the exception that the same developing blade 2 was used and the abutting pressure was set low. In this case, the abutting pressure P [g/cm] was set low, whereby the toner conveyance amount somewhat increased, but the occurrence of faulty images was null, and stable toner layer thickness regulation could be effected. Also, by a reduction in mechanical stress given to the toner T, good image density could be obtained during a long period of use.

SPECIFIC EXAMPLE 1-3

Evaluation was effected under the same condition as Specific Example 1-1 above with the exception that the same developing blade 2 was used and the NE length $L_{NE}$ [mm] was set to a great value. Again in this case, the NE length $L_{NE}$ [mm] was set to a great value, whereby the toner conveyance amount somewhat increased, but the occurrence of faulty images was null, and stable toner layer thickness regulation could be effected.

SPECIFIC EXAMPLE 1-4 to SPECIFIC EXAMPLE 1-7

These are examples in which in the construction of Specific Example 1-1, the degree of circularity of the toner T was changed as a parameter. Regarding a toner T of which the mean degree of circularity is great, the toner coat amount tends to increase. However, it can be seen that by the developing blade 2 being subjected to the surface roughening process, the toner coat amount tends to become stable.

Further, when an experiment was carried out with the abutting condition changed and the nip width $L_N$ changed, a case where the nip width $L_N$ was smaller than 0.40 [mm] resulted in an increase in the toner coat amount. When conversely, the nip width $L_N$ was set to 0.40 [mm] or greater, there was obtained a result that the toner coat amount became stable. It is considered to be preferable for obtaining a regulating effect that there are at least two irregularities in the rotation direction of the developing sleeve 1 in the blade nip portion N.

Summary of the Result of Table 1

It can be seen that as in Specific Examples 1 above according to the present embodiment, the surface roughening process is thus applied to the surface of the developing blade 2, whereby as compared with Comparative Examples 0, it is difficult to be affected by the fluctuations of the abutting pressure and the NE length and toner layer thickness regulation can be effected stably. That is, according to the present embodiment, utilization is made of the mechanism that conveyance resistance is given to the toner T by the uneven shape of the surface of the developing blade 2, whereby the suppression of the toner conveyance amount is effected. Therefore, an effect can be displayed even in a case where the conventional control by the abutting pressure the NE length is additionally acted on and the abutting pressure and the NE length are fluctuated.

That is, according to the present embodiment, there can be effected stable toner layer thickness regulation which is difficult to be affected by the fluctuations of the states of the vicinity of the blade nip portion N and the toner T due to such factors as an environmental fluctuation and mounting accuracy. Therefore, the provision of additional means and inconveniences in cost occurring in enhancing parts and mounting accuracy can be avoided.

EXPERIMENTAL EXAMPLE 2

Next, the manufacturing condition in the surface roughening process was changed to thereby prepare developing blades 2 having various surface shapes, and a print test similar to that in Experimental Example 1 above was carried out to thereby effect image evaluation. The result of the evaluation is shown in Table 2 below.

The image evaluation as in Experimental Example 1, was effected regarding uneven image density (uneven image) in continuing print-outputted halftone images (600 dpi, coverage rate 80%), and streaked images on the same halftone images. At this time, use was made of the abutting pressure of P=25 [g/cm], the NE length of $L_{NE}$=1.5 [mm] and the surface roughness of the developing sleeve 1 of Ra=1.2 [μm].

In Table 2, regarding which is given the mark *, the developing blade 2 was prepared by the use of a method of surface-roughening a metal mold surface by blasting. At that time, the kind and discharging condition of blast particles were adjusted to thereby prepare the developing blades 2 so as to assume different surface shapes. Also, the other developing blades 2 in Table 2 were prepared by the use of the aforedescribed method of surface-roughening the mold releasing layer of the inner peripheral surface of the metal mold. At that time, the kind, particle diameter and dispersing condition of particles present on the surface of the mold releasing layer were adjusted to thereby prepare the developing blades 2 so as to assume different surface shapes.

TABLE 2

| | Rz | Ry | A2 | Rpk | Rp | Sm | Rvk | M[g/m$^2$] | Uneven image | Streaked image |
|---|---|---|---|---|---|---|---|---|---|---|
| Specific Example 1-1 | 2.5 | 3.5 | 0.290 | 0.2 | 0.9 | 0.05 | 1.01 | 15 | ○ | ○ |
| Specific Example 2 | 2 | 3.1 | 0.210 | 0.2 | 0.8 | 0.11 | 1.06 | 16 | ○ | ○ |
| Specific Example 3 * | 3 | 4.5 | 0.100 | 1 | 2.2 | 0.12 | 1.21 | 17 | ○ | ○ |
| Specific Example 4 | 3.5 | 5.5 | 0.220 | 1.1 | 2.6 | 0.03 | 2.21 | 17 | ○ | ○ |
| Specific Example 5 * | 5.1 | 6.5 | 0.153 | 1.18 | 2.38 | 0.12 | 1.66 | 16 | ○ | ○ |
| Specific Example 6 * | 6.3 | 9 | 0.543 | 0.64 | 1.91 | 0.10 | 1.28 | 15 | ○ | ○ |

TABLE 2-continued

| | Rz | Ry | A2 | Rpk | Rp | Sm | Rvk | M[g/m$^2$] | Uneven image | Streaked image |
|---|---|---|---|---|---|---|---|---|---|---|
| Specific Example 7 | 7.2 | 9.5 | 0.820 | 0.7 | 3 | 0.09 | 3.50 | 14 | ○ | ○ |
| Specific Example 8 * | 5 | 6.5 | 0.140 | 1.1 | 2.6 | 0.16 | 1.87 | 18 | ○ | ○ |
| Specific Example 9 | 2.52 | 5.6 | 0.237 | 0.08 | 0.59 | 0.12 | 2.10 | 15 | ○ | ○ |
| Specific Example 10 | 3.72 | 6 | 0.344 | 0.18 | 0.96 | 0.07 | 1.95 | 14 | ○ | ○ |
| Specific Example 11 | 9.12 | 11 | 0.810 | 0.42 | 3.32 | 0.15 | 3.56 | 14 | ○ | ○ |
| Specific Example 12 | 10.3 | 14.5 | 1.310 | 2 | 4.57 | 0.17 | 5.53 | 14 | ○ | ○ |
| Comparative Example 0 (smooth) | 0.26 | 0.34 | 0.010 | 0.14 | 0.21 | 0.30 | 0.13 | 24 | X | ○ |
| Comparative Example 1 | 2.5 | 3.5 | 0.060 | 0.9 | 2 | 0.08 | 0.46 | 24 | X | ○ |
| Comparative Example 2 * | 3.5 | 5 | 0.090 | 0.9 | 2.4 | 0.10 | 0.81 | 23 | X | ○ |
| Comparative Example 3 * | 3.5 | 5.4 | 0.140 | 1 | 2.6 | 0.21 | 0.71 | 21 | Δ | ○ |
| Comparative Example 4 * | 4.3 | 5.7 | 0.150 | 1.1 | 2.7 | 0.25 | 0.89 | 22 | X | ○ |
| Comparative Example 5 | 6 | 9 | 0.460 | 2.2 | 3.9 | 0.10 | 2.60 | 13 | ○ | X |
| Comparative Example 6 * | 3 | 4.5 | 0.190 | 2.3 | 3.2 | 0.13 | 2.05 | 14 | ○ | X |
| Comparative Example 7 * | 6.5 | 9 | 0.130 | 1.6 | 5.5 | 0.11 | 1.52 | 14 | ○ | X |
| Comparative Example 8 * | 5.5 | 9.2 | 0.120 | 1.5 | 5.2 | 0.11 | 1.06 | 14 | ○ | Δ |
| Comparative Example 9 | 13 | 18 | 1.340 | 1.8 | 6.8 | 0.19 | 2.00 | 15 | ○ | X |
| Comparative Example 10 | 15 | 21 | 1.620 | 3.2 | 9 | 0.24 | 3.12 | 14 | ○ | X |

SPECIFIC EXAMPLES

Specific Example 1-1 and Specific Example 2

In Specific Example 1-1 and Specific Example 2, the developing blades 2 were prepared by a technique of surface-roughening the mold releasing layer of the inner peripheral surface of the mold. Rz and Ry are relatively small values, but the value of A2 is sufficient. Good toner layer thickness regulation could be effected.

Specific Example 3

In Specific Example 3, the developing blade 2 was prepared by a technique of surface-roughening the metal mold surface by blasting using spherical particles. As compared with Specific Example 1-1 and Specific Example 2, the values of Rz and Ry are great, but the value of A2 is small, and the value of Sm is somewhat great. Therefore, the toner conveyance amount slightly increased, but good toner layer thickness regulation could be effected.

Specific Example 4

In Specific Example 4, as in Specific Example 2, the developing blade 2 was prepared by the technique of surface-roughening the mold releasing layer of the inner peripheral surface of the metal mold. The value of A2 was sufficient and therefore, good toner layer thickness regulation could be effected. On the other hand, the values of Rpk and Rp were great, but there was not the problem of streaked images.

Specific Example 5 and Specific Example 6

In Specific Example 5 and Specific Example 6, the developing blade 2 were prepared by a technique of surface-roughening the metal mold surface by blasting using amorphous particles. The surface shape of this developing blade is one in which the values of Rpk and Rp are relatively great. However, the occurrence of streaked images was null. In these cases, the value of A2 was secured sufficiently and therefore, the suppression of the toner conveyance amount could be effected.

Specific Example 7

In Specific Example 7, the developing blade 2 was prepared by the technique of surface-roughening the mold releasing layer of the inner peripheral surface of the metal mold. The content of spherical particles in the mold releasing layer of the metal mold was increased to thereby adjust the value of A2 so as to become greater. In this case, A2 is sufficiently secured and the suppressing effect for the toner conveyance amount is great. On the other hand, the values of Rpk and Rp were made small for the rate of Rz and therefore, no streaked image occurred. As described above, the technique by the surface roughening of the mold releasing layer has the feature that it can form concave portions large while making the height of convex portions small.

Specific Example 8

In Specific Example 8, the developing blade 2 was prepared by the technique of surface-roughening the metal mold surface by blasting using spherical particles. By using particles having a larger particle diameter in blasting than in Specific Example 3, adjustment was effected so that the value of Sm might become great. In this case, as compared, for example, with Specific Example 3, the values of Rz, Ry and A2 are great, nevertheless the toner conveyance amount increased. This represents that by the value of Sm being great, the toner layer thickness regulating force was reduced. In Specific Example 8, however, faulty images did not occur, and toner layer thickness regulation could be effected.

Specific Example 9 and Specific Example 10

In Specific Example 9 and Specific Example 10, the developing blade 2 was prepared by the technique of surface-roughening the mold releasing layer of the inner peripheral surface of the metal mold. The content of spherical particles in the mold releasing layer of the metal mold was increased to thereby adjust the value of A2 so as to become greater. In this case, A2 is secured sufficiently and the suppressing effect for the toner conveyance amount is great.

Specific Example 11 and Specific Example 12

In Specific Example 11 and Specific Example 12, the developing blades 12 were prepared by the technique of surface-roughening the mold releasing layer of the inner peripheral surface of the metal mold. The particle diameter of spherical particles in the mold releasing layer of the metal mold was made large and the content thereof was further increased to thereby adjust the value of A2 so as to become greater. The suppressing effect for the toner conveyance amount is great. On the other hand, the values of Rpk and Rp become great, but no streaked image occurred.

COMPARATIVE EXAMPLES

Comparative Example 1 and Comparative Example 2

Comparative Example 1 and Comparative Example 2 are by different preparing methods. However, in both of them, as compared, for example, with Specific Example 1-1, Specific Example 2 and Specific Example 3, the surface shape is such that Rpk, Pp, Rz and Ry are relatively great, but A2 is small. In any of print tests using these developing blades 2, the toner conveyance amount increased and uneven image occurred. From this, it can be seen that the toner layer thickness regulating force is affected by the capacity of concave portions, and when the value of A2 is small, a faulty image due to the deficiency of the toner layer thickness regulating force occurs.

Comparative Example 3 and Comparative Example 4

In Comparative Example 3 and Comparative Example 4, the developing blades 2 were prepared by the use of particles having a large particle diameter with the discharging pressure of blasting made small and the metal mold surface being roughened. For example, as compared with Specific Example 5, the surface shape is such that Sm is great. In these cases, in print tests, the tendency of the toner conveyance amount somewhat increasing was seen, and slight uneven image occurred. From this, it can be seen that the toner layer thickness regulating force is affected by the value of Sm, and to effect stable toner layer thickness regulation, it is necessary to make the value of Sm small.

Comparative Example 5

In Comparative Example 5, the developing blade 2 was prepared so that the value of A2 might become great by the particle diameter of spherical particles used for the surface roughening of the surface of the mold releasing layer of the inner peripheral surface of the metal mold being made large. In this case, as compared, for example, with Specific Example 5 to Specific Example 7, the surface shape is such that Rpk is great. In a print test, although there was no problem in the toner regulating force, the toner layer was partly disturbed by localized convex portions, whereby streaked images occurred. This means that the particle diameter of particles used for the surface roughening of the mold releasing layer of the metal mold was large and irregularities in the surface shape occurred to thereby cause a localized defect.

Comparative Example 6

In Comparative Example 6, the developing blade 2 was prepared with the metal mold surface roughened by blasting using amorphous particles. The developing blade 2 was made into a surface shape in which Rpk is relatively great. Again in this case, as in Comparative Example 5, streaked images attributable to localized concave portions occurred. From this, it can be seen that to prevent streaked images, it is necessary to suppress convex portions and it is necessary to make the value of Rpk small.

Comparative Example 7 and Comparative Example 8

In Comparative Example 7 and Comparative Example 8, the developing blades 2 were prepared with the metal mold surface roughed by blasting using amorphous particles. Also, the developing blades 2 were prepared so that they might differ in the value of Rp from each other. In these developing blades 2, as compared with Specific Example 5 to Specific Example 7, the surface shapes thereof are such that the value of Rp is great. In print tests using these developing blades 2, the toner layer was disturbed by high convex portions over a wide range, and streaked images occurred. From this, it can also be seen that to prevent streaked images, it is necessary to suppress convex portions and it is necessary to make the value of Rp small.

Comparative Example 9 and Comparative Example 10

In Comparative Example 9 and Comparative Example 10, the developing blades 2 were prepared by making the particle diameter of spherical particles used for the surface roughening of the surface of the mold releasing layer of the inner peripheral surface of the metal mold large, and further making the added amount thereof great so that the value of A2 might become great. In this case, the spherical particles gather in the mold releasing layer of the metal mold and the unevenness of irregularity or the sea island state becomes great. Therefore, localized convex portions (great in Rp) are formed. Also, a surface shape which is great in the unevenness of irregularities (great in Sm) results. Due to these, the toner layer was partly disturbed, whereby streaked images occurred. If concave portions are too large, it seems that the toner lightly condenses in the concave portions and the coat is disturbed and causes coat streaks.

Summary of the Result of Table 2

The foregoing result will be summed up below.

Figure 8:
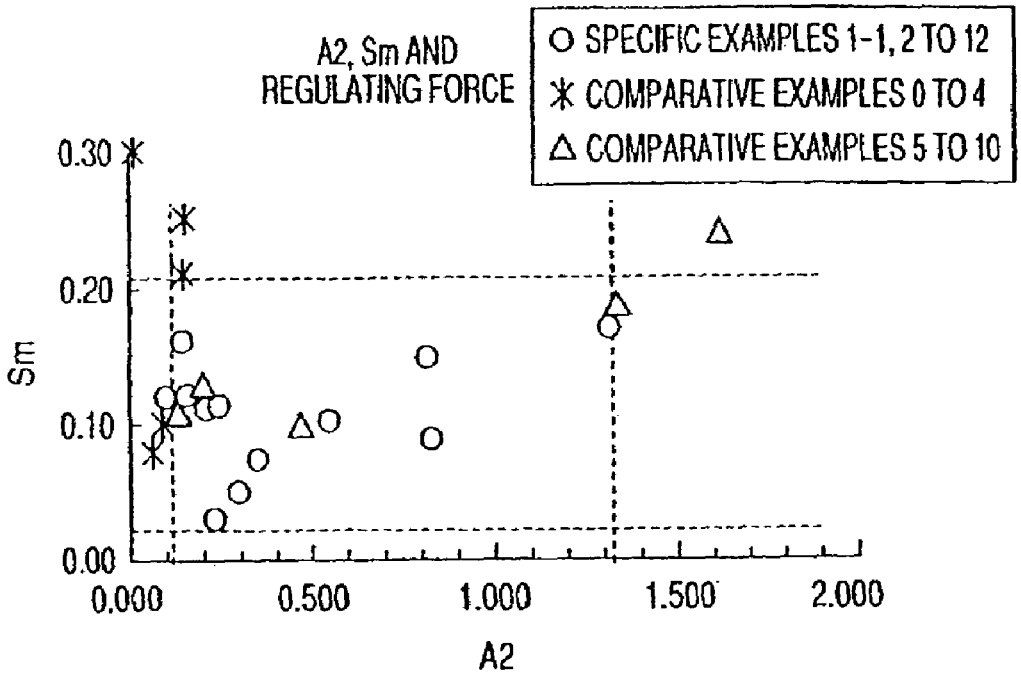
FIG. 8 is a graph representing the surface shape of the developing blade by surface roughness parameters A2 and Sm.

(1) To the toner layer thickness regulating Force (the regulating force for the toner conveyance amount):

FIG. 8 shows the result of uneven coat (uneven image) to A2 and Sm. As the surface roughness parameter of the developing blade 2 in the blade nip portion N by which a satisfactory result can be obtained about the stabilization of the toner layer thickness regulating force, A2 is within the following range:

$$0.1 \leqq A2$$

That is, it is effective to make the capacity of the concave portions on the surface of the developing blade 2 large to thereby generate conveyance resistance to the toner. A2, if it is 0.1 or greater, will be effective.

Also, as the surface roughness parameter of the developing blade 2 in the blade nip portion N by which a satisfactory result can be obtained about the stabilization of the toner layer thickness regulating force, Sm is within the following range:

$$0.030 \leqq Sm \leqq 0.200$$

Particularly, in a developing blade wherein A2 is small, if Sm exceeded 0.2, the regulating force became small and uneven coat occurred Regarding the lower limit of Sm, if it is 0.030 or greater, a good result can be obtained.

Figure 9:
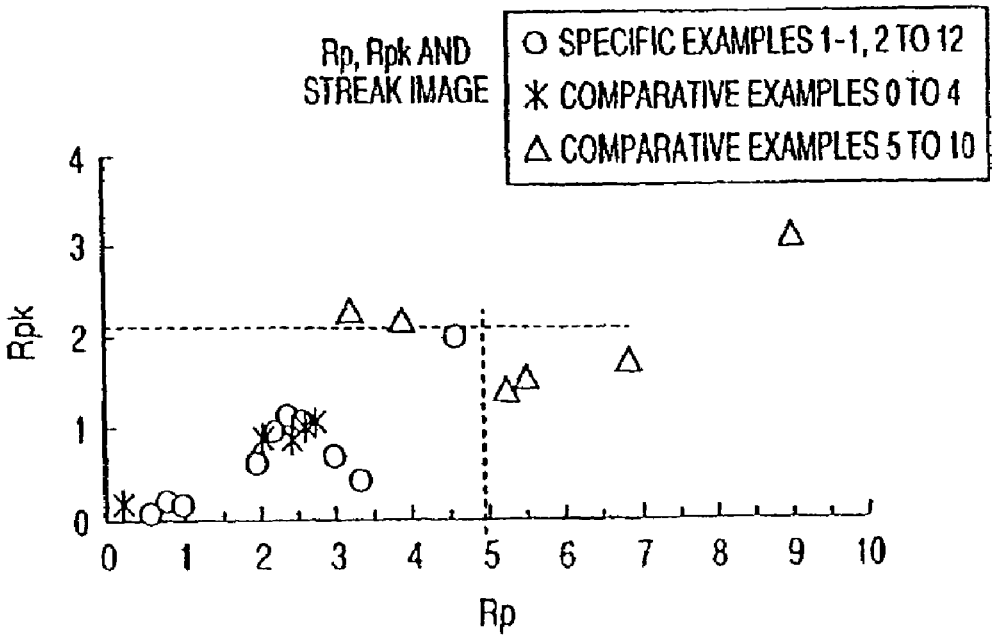
FIG. 9 is a graph representing the surface shape of the developing blade by surface roughness parameters Rp and Rpk.

(2) To image streaks:

FIG. 9 shows the result of coat streaks (streaked images) to Rp and Rpk.

As the surface roughness parameter of the developing blade 2 in the blade nip portion N by which a satisfactory result can be obtained about the prevention of streaked images, Rpk and Rp are within the following respective ranges:

$$Rpk \leqq 2.0$$

$$Rp \leqq 5.0$$

That is, it is important to make the height of the convex portions on the surface of the developing blade 2 small so as not to disturb the toner coat. Also, it is necessary to make Rpk and Rp smaller than respective predetermined values. To secure the capacity of the concave portions, convex portions are inevitably formed for a reason in the manufacture wherein the metal mold is surface-roughened. For such a reason, Rpk is usually 0.05 μm or greater. Also, for a similar reason, Rp is usually 0.5 μm or greater.

Also, as the surface roughness parameter of the developing blade 2 in the blade nip portion N by which a satisfactory result can be obtained about the prevention of streaked images, Sm and A2 are within the following respective ranges:

$$0.030 \leqq Sm \leqq 0.1700$$

$$A2 \leqq 1.30$$

That is, from the relation between A2 and Sm shown in FIG. 8, there is no upper limit of A2 from the view point of the toner layer thickness regulating force. However, if A2 becomes great, Sm also tends to become great. When A2 and Sm became great, the unevenness of irregularities became great, and coat streaks occurred (Comparative Example 9 and Comparative Example 10). This is considered to be because when the concave portions become large, the toner lightly condenses in the concave portions and the toner coat on the developing sleeve 1 is disturbed and becomes streaks. From this viewpoint, the upper limits of Sm and A2 are determined.

(3) Relation between Rpk and Rvk

Figure 10:
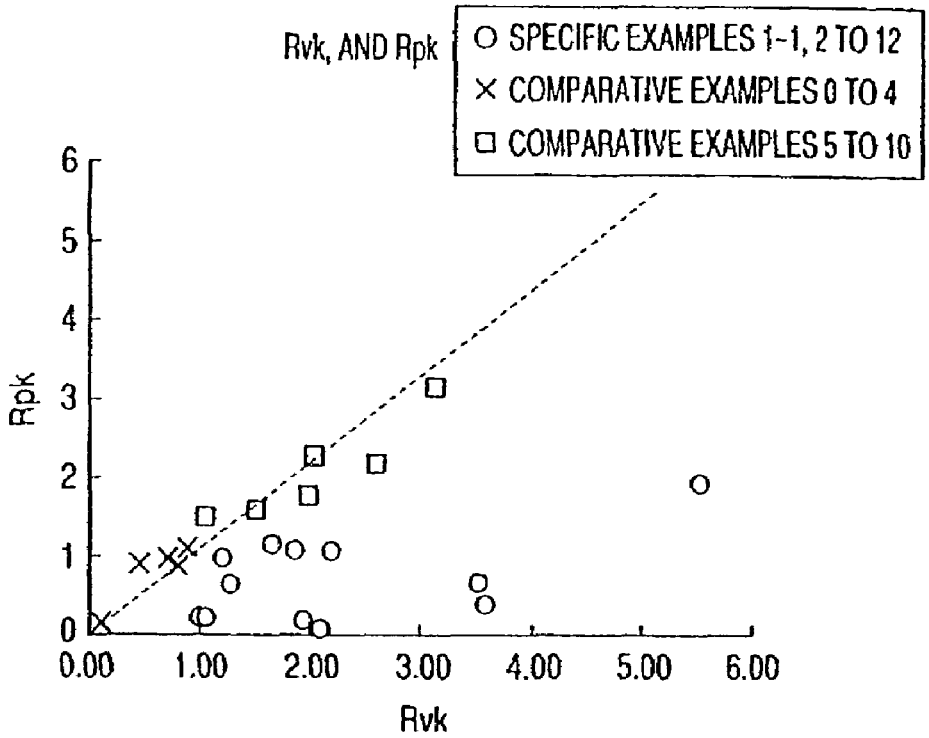
FIG. 10 is a graph representing the surface shape of the developing blade by surface roughness parameters Rvk and Rpk.

FIG. 10 shows the relation between Rpk and Rvk. As can be seen from FIG. 10, to make the stabilization of the toner layer thickness regulating force and the prevention of the occurrence of streaked images compatible, it is important for Rpk and Rvk indicative of the roughness shape of the developing blade 2 to have the following relation:

$$Rpk < Rvk$$

That is, as described above, it is important for the surface shape of the developing blade 2 to be a shape which suppresses the heights (Rpk and Rp) of the convex portions, and yet secures the capacity (A2) of the concave portions. That is, the shape of the surface of the developing blade 2 according to the present invention in the blade nip portion N is characterized in that A2 is great for Rz, and Rp and Rpk are small for Rz. These are shown in FIGS. 11 to 13.

Figure 11:
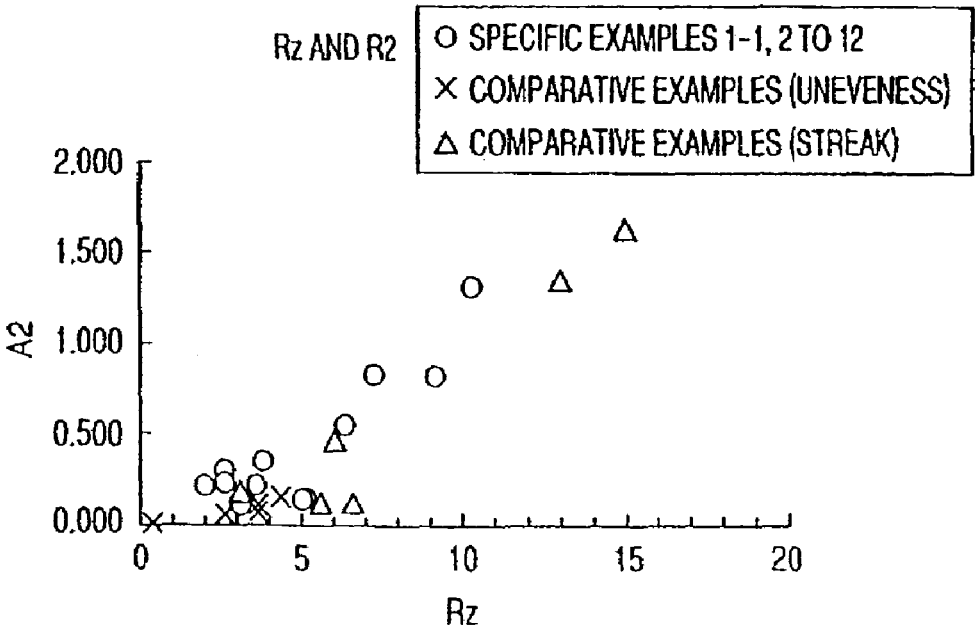
FIG. 11 is a graph representing the surface shape of the developing blade by surface roughness parameters Rz and A2.

FIG. 11 shows the relation between Rz and A2. It will be seen that as compared with the comparative examples in which uneven coat (uneven image) and coat streaks (streaked images) occurred, A2 is great relative to Rz in the plot of the specific examples (Specific Example 1-1 and Specific Example 2 to Specific Example 12) according to the present invention.

Figure 12:
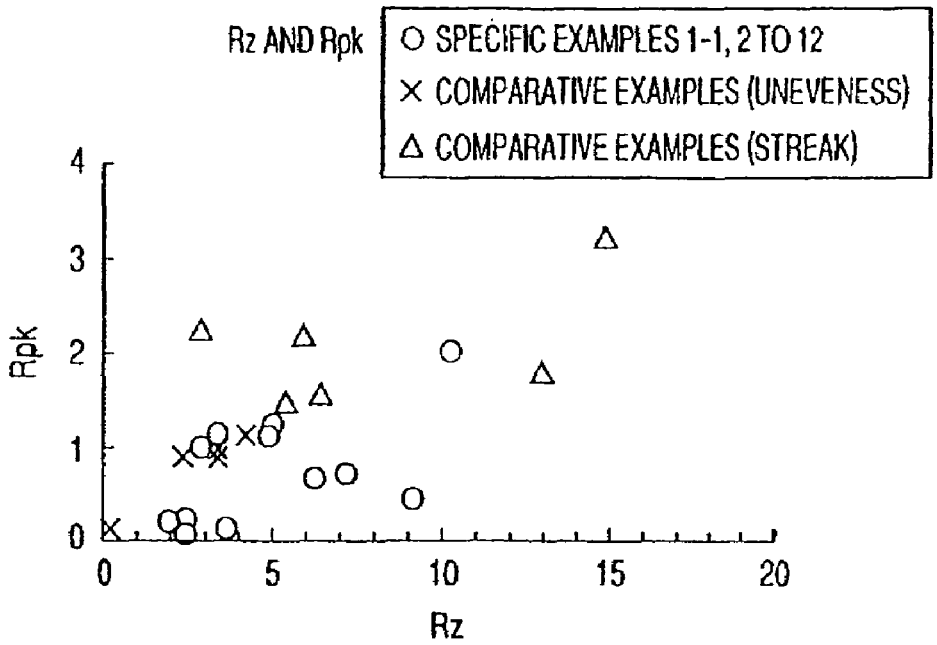
FIG. 12 is a graph representing the surface shape of the developing blade by surface roughness parameters Rz and Rpk.

FIG. 12 shows the relation between Rz and Rpk. It will be seen that as compared with the comparative examples in which uneven coat (uneven image) and coat streaks (streaked images) occurred, Rpk is small relative to Rz in the plot of the specific examples (Specific Example 1-1 and Specific Example 2 to Specific Example 12) according to the present invention.

Figure 13:
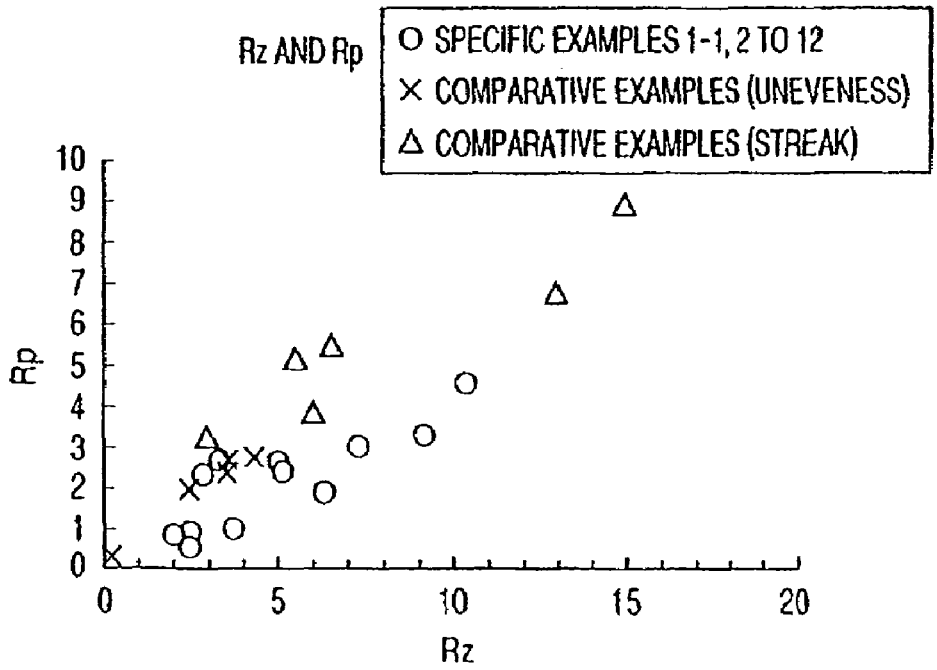
FIG. 13 is a graph representing the surface shape of the developing blade by surface roughness parameters Rz and Rp.

FIG. 13 shows the relation between Rz and Rp. It will be seen that as compared with the comparative examples in which uneven coat (uneven image) and coat streaks (streaked images) occurred, Rpk is small relative to Rz in the plot of the specific examples (Specific Example 2 to Specific Example 12) according to the present invention.

Further, the present invention has the effect of making Sm proper to thereby improve the uniformity of the toner coat on the developing sleeve 1.

Figure 14:
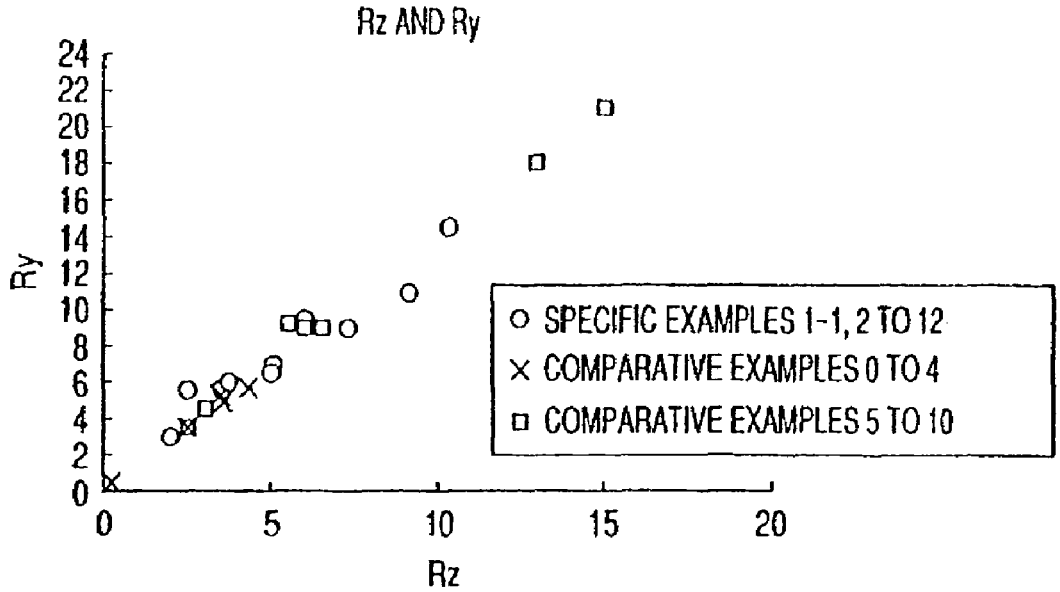
FIG. 14 is a graph representing the surface shape of the developing blade by surface roughness parameters Rz and Ry.

In contrast, it will be seen that as shown in FIG. 14, the surface shape of the developing blade 2 necessary for making the toner layer thickness regulating force and the prevention of the occurrence of streaked images compatible is difficult to express by the values of Rz and Ry (Rmax). By simply prescribing Rz and Rmax, it is impossible to make these compatible.

As described above, according to the present embodiment, at least the abutment portion (the portion corresponding to the blade nip portion N) of the developing blade 2 against the developing sleeve is surface-roughened, and the surface roughness parameter thereof satisfies the following expressions (1) to (5):

$$0.030 \leqq Sm \leqq 0.170 \quad (1)$$

$$Rpk \leqq 2.0 \quad (2)$$

$$Rp \leqq 5.0 \quad (3)$$

$$0.10 \leqq Rvk \times (100 - Mr2)/100 \leqq 1.30 \quad (4)$$

$$Rpk < Rvk \quad (5)$$

(Here, Sm is the mean spacing [mm] of profile irregularities prescribed by JIS-B0601-1994.

Rp is the maximum profile peak height [μm] prescribed by ISO4287-1997.

Rpk is the initial wear height (the height of the profile peak portion off the level difference Rk of the roughness core) [μm] prescribed by DIN4776.

Rvk is the oil retaining depth (the depth of the valley portion off the level different Rk of the roughness core) [μm] prescribed by DIN4776.

Mr2 is the profile bearing length ratio 2 (the profile bearing length ratio corresponding to the lower limit value of the level difference Rk of the roughness core) [%] prescribed by DIN 4776.

Thereby, good images could be obtained without the occurrence of uneven image density and streaked images. That is, about the surface shape of that portion of the developing blade 2 which corresponds to the blade nip portion N, the shapes of the convex portions and concave portion in which streaked image do not occur, and the shape of the concave portions necessary for the stabilization of the toner coat are prescribed in detail. Thereby, the occurrence of streaked images can be prevented and a stable toner layer thickness regulating force can be obtained. Also, the occurrence of streaked images due to the influence of irregularities in parts or the like can be prevented, and highly accurate toner layer thickness regulation can be stably effected. Also, in the present embodiment, the surface of the developing blade in at least the blade nip portion N is constituted by an elastic member. Thereby, stable toner layer thickness regulation can be effected by the use of an inexpensive elastic blade constituted by an elastic member of urethane rubber, silicone rubber or the like as the developing blade 2.

As described above, according to the present embodiment, the stabilization of toner layer thickness regulation and the prevention of the occurrence of streaked images can be made compatible. That is, according to the present embodiment, stable toner layer thickness regulation can be effected while streaked images are supported, by an inexpensive method. Also, according to the present embodiment, even when use is made of a toner having a high degree of circularity, the occurrence of streaked images can be prevented and stable toner layer thickness regulation can be effected for a long period of time, by an inexpensive method.

While in the above-described embodiments, an elastic rubber member is used as the developing blade 2, the present invention is not restricted thereto. The developing blade 2 can be any blade having moderate elasticity, and the material thereof is not particularly restricted. Also, in the above-described embodiments, as the abutting method of the developing blade 2 against the developing sleeve 1, description has been made of an example in which the developing blade abuts in a counter direction to the rotation of the developing sleeve 1. However, this is not restrictive, but the present invention is also effective for a case where the developing blade abuts, for example, in a forward direction.

Also, the developing blade 2 according to the present invention described with respect to the foregoing embodiments displays a particularly great effect by the combination thereof with a toner having a high degree of circularity. However, the present invention can also be applied to a case where use is made of a toner having a low degree of circularity, and an effect similar to that described above can be obtained.

Also, in the above-described embodiments, as the developer carrying member, use is made of a sleeve formed of a nonmagnetic metal material. The present invention however, is not restricted thereto, but the present invention is also applicable to a case where as the developer carrying member, use is made, for example, of a roller of which the surface layer comprises an elastic member. As the developer carrying member, use can be made of any member having a sufficient toner conveying force.

Also, in the above-described embodiments, the developer has been described as being a magnetic mono-component developer (magnetic toner). As previously described, in the developing apparatus using the magnetic toner, there is not the action of scraping off the toner from the developer carrying member and therefore, the problem that the amount of the toner conveyed to the developing area past the developer layer thickness regulating member increases is liable to arise. Therefore, the present invention acts particularly effectively in the developing apparatus using the magnetic mono-component developer (magnetic toner). The present invention, however, is not restricted thereto, but can also be applied to any developing apparatus using, for example, a nonmagnetic mono-component developer if it uses a mono-component developer, and can obtain an effect similar to that described above.

Figure 15:
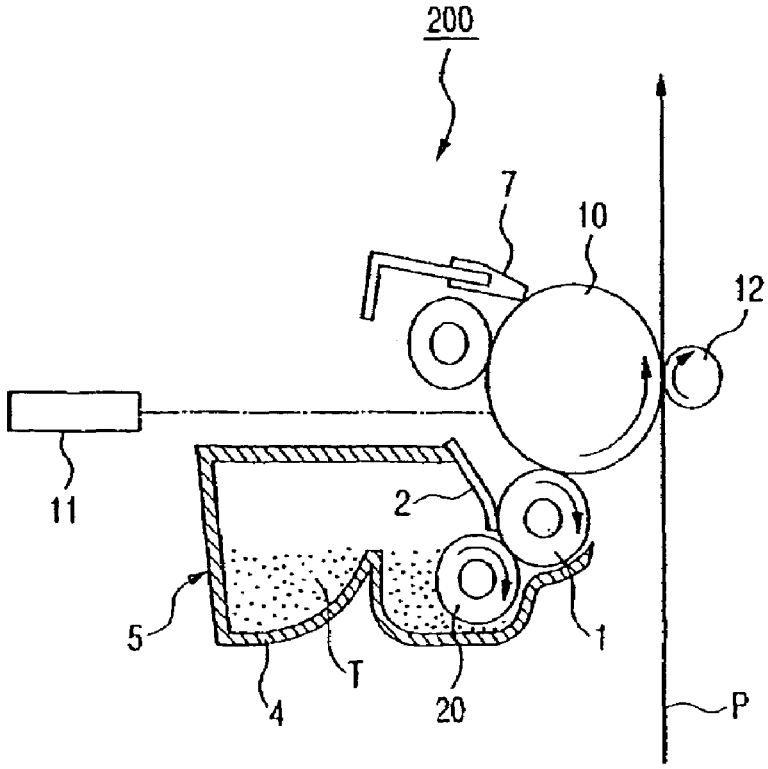
FIG. 15 is a cross-sectional view schematically. showing the construction of another embodiment of the image forming apparatus to which the present invention can be applied.

For example, FIG. 15 schematically shows the cross sectional construction of the essential portions of an example of an image forming-apparatus provided with a developing apparatus using a nonmagnetic mono-component developer (nonmagnetic toner). In FIG. 15, elements with or corresponding to those in the image forming apparatus 100 of FIG. 1 are given the same reference characters and need not be described in detail.

In the image forming apparatus 200 shown in FIG. 15, a developing apparatus 5 has a developing roller 1 as a developer carrying member. The developing roller 1 is rotated while being in contact with a photosensitive member 10 during a developing operation. As indicated by the arrows in FIG. 15, the photosensitive member 10 and the developing roller 1 are rotated so that in the contact portion therebetween, the surface movement directions thereof may be the same directions. Also, the developing apparatus 5 has a supplying roller 20 as a developer supplying member. The supplying roller 20 is rotated while being in contact with the developing roller 1. As indicated by the arrows in FIG. 15, the developing roller 1 and the supplying roller 20 are rotated so that in the contact portion threbetween the surface movement directions thereof may be opposite directions (counter directions). The supplying roller 20 is formed by an elastic member such as a foam. Thereby a nonmagnetic toner T is applied onto the developing roller 1 by the supplying roller 20. Also, a developing blade 2 as a developer layer thickness regulating member abuts against the developing roller 1. The toner T carried on and conveyed by the developing roller 1 has its layer thickness regulated by the developing blade 2 and also, has triboelectric charges imparted thereto. Thereafter, the toner T is conveyed to the contact portion with the photosensitive member 10, and is used for the development of an electrostatic image on the photosensitive member 10. On the other hand, the supplying roller 20 strips off any toner (developing residual toner) residual on the developing roller after having passed a developing position.

The developing blade 2 provided in the developing apparatus 5 of this image forming apparatus 200 can be constructed in accordance with the present invention. Thereby, as described above, the stabilization of toner layer thickness regulation and the prevention of the occurrence of streaked images can be made compatible.

Also, in the above-described embodiments, the developing apparatus 5 has been described as being detachably mountable as the process cartridge C with respect to the apparatus main body A. The present invention, however, is not restricted thereto, but the developing apparatus may be made as a developing cartridge singly detachably mountable to the apparatus main body.

Further, the developing apparatus need not be made into a cartridge (a process cartridge or a developing cartridge) detachably mountable to the apparatus main body. Of course, the present invention can equally be applied to an image forming apparatus in which the developing apparatus is substantially fixed to the main body of the image forming apparatus.

This application claims priority from Japanese Patent Application No. 2005-272981 filed on Sep. 20, 2005, which is hereby incorporated by reference herein.

What is claimed is:

1. A developer regulating member, which abuts against a developer carrying member, which carries a mono-component developer to regulate a layer thickness of the developer on the developer carrying member, said developer regulating member comprising:

a supported portion to be supported by a support member; and an abutting portion, which abuts against the developer carrying member, surface roughness parameters of said abutting portion satisfying the following expressions (1) to (5):

$$0.030 \leqq Sm \leqq 0.170 \quad (1)$$

$$Rpk \leqq 2.0 \quad (2)$$

$$Rp \leqq 5.0 \quad (3)$$

$$0.10 \leqq Rvk \times (100 - Mr2)/100 \leqq 1.30 \quad (4)$$

$$Rpk < Rvk \quad (5)$$

where

Sm is a mean spacing [mm] of profile irregularities prescribed by JIS-B0601-1994, Rp is a maximum profile peak height [μm] prescribed by ISO4287-1997, Rpk is an initial wear height [μm] prescribed by DIN4776, Rvk is an oil retaining depth [μm] prescribed by DIN4776, and Mr2 is a profile bearing length ratio [%] corresponding to the lower limit value of a level difference Rk of a roughness core.

2. A developer regulating member according to claim 1, wherein said abutting portion is an elastic member.

3. A developer regulating member according to claim 1, wherein an abutting width of said developer regulating member against the developer carrying member is 0.40 mm or greater.

4. A developer regulating member according to claim 1, wherein the mono-component developer has a mean degree of circularity of 0.940 or greater.

5. A developer regulating member according to claim 4, wherein the mono-component developer is a magnetic developer.

6. A developer regulating member according to claim 2, wherein said abutting portion is 55° to 85° in terms of JIS-A hardness.

7. A developer regulating member according to claim 1, wherein the mono-component developer has a weight mean particle diameter of 5.0 to 8.0 μm.

8. A developing apparatus comprising:

a developer carrying member, which carries a mono-component developer;

a developer regulating member, which regulates a layer thickness of the developer on said developer carrying member, said developer regulating member comprising an abutting portion abutting against said developer carrying member, surface roughness parameters of said abutting portion satisfying the following expressions (1) to (5):

$$0.030 \leqq Sm \leqq 0.170 \quad (1)$$

$$Rpk \leqq 2.0 \quad (2)$$

$$Rp \leqq 5.0 \quad (3)$$

$$0.10 \leqq Rvk \times (100 - Mr2)/100 \leqq 1.30 \quad (4)$$

$$Rpk < Rvk \quad (5)$$

where

Sm is a mean spacing [mm] of profile irregularities prescribed by JIS-B0601-1994, Rp is a maximum profile peak height [μm] prescribed by ISO4287-1997, Rpk is an initial wear height [μm] prescribed by DIN4776, Rvk is an oil retaining depth [μm] prescribed by DIN4776, and Mr2 is a profile bearing length ratio [%] corresponding to the lower limit value of a level difference Rk of a roughness core.

9. A developing apparatus according to claim 8, wherein said abutting portion is an elastic member.

10. A developing apparatus according to claim 8, wherein an abutting width of said developer regulating member against said developer carrying member is 0.40 mm or greater.

11. A developing apparatus according to claim 8, wherein the mono-component developer has a mean degree of circularity of 0.940 or greater.

12. A developing apparatus according to claim 11, wherein the mono-component developer is a magnetic developer.

13. A developing apparatus according to claim 9, wherein said abutting portion is 55° to 85° in terms of JIS-A hardness.

14. A developing apparatus according to claim 8, wherein the mono-component developer has a weight means particle diameter of 5.0 to 8.0 μm.

15. A developing apparatus according to claim 12, further comprising magnetic field generating means in an interior of said developer carrying member.

16. A developing apparatus according to claim 8, wherein a surface roughness parameter of said developer carrying member satisfies the following expression:

$$0.5 \leqq Ra \leqq 2.0,$$

where Ra is an arithmetic mean roughness [μm] prescribed by JIS-B0601-1994.

17. A developing apparatus according to claim 8, wherein said developing apparatus is provided in a cartridge detachably mountable to a main body of an image forming apparatus.

18. A developing apparatus according to claim 8, wherein said developing apparatus is provided in a cartridge detachably mountable to a main body of an image forming apparatus, together with an image bearing member on which said developing apparatus developing-acts.

* * * * *

UNITED STATES PATENT AND TRADEMARK OFFICE

CERTIFICATE OF CORRECTION

PATENT NO. : 7,289,756 B2
APPLICATION NO. : 11/255974
DATED : October 30, 2007
INVENTOR(S) : Hideaki Hasegawa et al.

It is certified that error appears in the above-identified patent and that said Letters Patent is hereby corrected as shown below:

COLUMN 5:
Line 28, “cross sectional” should read --cross-sectional--.

COLUMN 6:
Line 7, “schematically.” should read --schematically--.

COLUMN 8:
Line 27, “portion” should read --portion.--.

COLUMN 9:
Line 43, “on the same side as the blade surface” should be deleted.

COLUMN 10:
Line 23, “biding” should read --binding--; and
Line 47, “fixed” should read --fix--.

COLUMN 11:
Line 26, “obtained” should read --to obtain--.

COLUMN 15:
In Table 1, Row 15, “Compaxative” should read --Comparative-- and “25” should read --26--.

COLUMN 17:
Line 27, “examples in” should read --examples--.

COLUMN 18:
Line 9, “pressure” should read --pressure/--.

COLUMN 20:
Line 39, “were” should read --was--.

COLUMN 21:
Line 46, “$P_p$,” should read --$R_p$,--.

COLUMN 22:
Line 39, “roughed” should read --roughened--.

UNITED STATES PATENT AND TRADEMARK OFFICE

CERTIFICATE OF CORRECTION

PATENT NO. : 7,289,756 B2
APPLICATION NO. : 11/255974
DATED : October 30, 2007
INVENTOR(S) : Hideaki Hasegawa et al.

It is certified that error appears in the above-identified patent and that said Letters Patent is hereby corrected as shown below:

COLUMN 23:
Line 5, "Force" should read --force--; and
Line 28, "occurred" should read --occurred.--.

COLUMN 25:
Line 9, "different" should read --difference--.

COLUMN 26:
Line 23, "cross" should read --cross- --;
Line 25, "forming-apparatus" should read --forming apparatus--; and
Line 45, "threbetween" should read --therebetween--.

Signed and Sealed this

First Day of July, 2008

JON W. DUDAS
*Director of the United States Patent and Trademark Office*